US009156223B2

(12) United States Patent
Stolzman et al.

(10) Patent No.: US 9,156,223 B2
(45) Date of Patent: Oct. 13, 2015

(54) CONTAINER WITH SIDEWALL AND CLOSURE

(71) Applicant: International Precision Components Corporation, Lake Forest, IL (US)

(72) Inventors: Michael D. Stolzman, Lake Forest, IL (US); Kenneth J. Kuzelka, Island Lake, IL (US); Wiktor Dydo, Gurnee, IL (US)

(73) Assignee: International Precision Components Corporation, Lake Forest, IL (US)

( * ) Notice: Subject to any disclaimer, the term of this patent is extended or adjusted under 35 U.S.C. 154(b) by 0 days.

(21) Appl. No.: 13/623,699

(22) Filed: Sep. 20, 2012

(65) Prior Publication Data

US 2014/0076889 A1 Mar. 20, 2014

(51) Int. Cl.

| | |
|---|---|
| ***B65D 8/22*** | (2006.01) |
| ***B31B 1/00*** | (2006.01) |
| ***B65D 8/00*** | (2006.01) |
| ***B65D 25/22*** | (2006.01) |
| ***B65D 43/02*** | (2006.01) |
| *B65D 6/32* | (2006.01) |

(52) U.S. Cl.

CPC . *B31B 1/00* (2013.01); *B65D 15/08* (2013.01); *B65D 15/24* (2013.01); *B65D 25/22* (2013.01); *B65D 43/0231* (2013.01); *B31B 2201/6013* (2013.01); *B31B 2217/082* (2013.01); *B65D 2543/00092* (2013.01); *B65D 2543/00296* (2013.01); *B65D 2543/00416* (2013.01); *B65D 2543/00435* (2013.01); *B65D 2543/00564* (2013.01)

(58) Field of Classification Search

CPC ..... B65D 2543/00564; B65D 2543/00453; B65D 2543/00416; B65D 2543/00296; B65D 2543/0092; B31B 2201/6013; B31B 2217/082

USPC ..... 220/634, 359.1, 611, 613, 612, 617

See application file for complete search history.

(56) References Cited

U.S. PATENT DOCUMENTS

| | | | | |
|---|---|---|---|---|
| D89,281 | S | 2/1933 | Karnell | |
| D94,324 | S | 1/1935 | Bergeron | |
| 2,354,921 | A * | 8/1944 | McClary | 220/612 |
| 2,356,401 | A | 8/1944 | Hatch | |
| 2,386,901 | A * | 10/1945 | Kline | 451/28 |
| 2,467,182 | A * | 4/1949 | Beattie | 413/5 |
| 3,101,857 | A | 8/1963 | Freedman | |
| 3,454,207 | A | 7/1969 | Jackson | |
| 3,470,929 | A | 10/1969 | Thornton | |

(Continued)

FOREIGN PATENT DOCUMENTS

| | | |
|---|---|---|
| EP | 0458662 | 11/1991 |
| EP | 2003065 | 12/2008 |

(Continued)

OTHER PUBLICATIONS

U.S. Appl. No. 29/432,816, filed Sep. 20, 2012, Stolzman et al.

(Continued)

*Primary Examiner* — Mickey Yu
*Assistant Examiner* — Niki Eloshway
(74) *Attorney, Agent, or Firm* — Reinhart Boerner Van Deuren s.c.

(57) ABSTRACT

A container is provided. The container includes a sidewall, a bottom closure, and a chime. The chime is coupled to a first end of the sidewall by adhesive. The bottom closure is coupled to a second end of the sidewall by adhesive.

19 Claims, 16 Drawing Sheets

(56) References Cited

U.S. PATENT DOCUMENTS

| | | | | | |
|---|---|---|---|---|---|
| 3,734,393 | A | | 5/1973 | Stump | |
| 3,899,117 | A | | 8/1975 | Peyser et al. | |
| 3,912,154 | A | * | 10/1975 | Godar | 229/5.5 |
| 3,913,774 | A | | 10/1975 | Vajtay | |
| 4,014,723 | A | | 3/1977 | Jones | |
| D248,544 | S | | 7/1978 | Saunders | |
| 4,135,657 | A | * | 1/1979 | Benson et al. | 229/5.7 |
| 4,182,475 | A | | 1/1980 | Freund | |
| 4,183,457 | A | | 1/1980 | Loughley et al. | |
| 4,201,306 | A | * | 5/1980 | Dubois et al. | 220/4.05 |
| 4,241,864 | A | | 12/1980 | Kessler | |
| 4,249,690 | A | | 2/1981 | Held | |
| 4,252,265 | A | | 2/1981 | Brundige et al. | |
| 4,305,535 | A | | 12/1981 | Brundige et al. | |
| 4,346,832 | A | | 8/1982 | Werner | |
| 4,355,759 | A | | 10/1982 | Amberg | |
| 4,495,209 | A | | 1/1985 | Whiteside | |
| 4,500,010 | A | | 2/1985 | Schütz | |
| 4,560,063 | A | | 12/1985 | Müller | |
| 4,700,867 | A | | 10/1987 | Dutt et al. | |
| 4,741,453 | A | | 5/1988 | Stolzman | |
| 4,757,936 | A | | 7/1988 | Homma et al. | |
| 4,762,249 | A | | 8/1988 | Fortuna et al. | |
| 4,805,798 | A | | 2/1989 | Stolzman | |
| 4,813,592 | A | | 3/1989 | Stolzman | |
| 4,852,792 | A | * | 8/1989 | Hale | 229/5.5 |
| 4,890,786 | A | | 1/1990 | Oberhofer et al. | |
| 4,893,861 | A | | 1/1990 | Stoltzman | |
| 4,905,859 | A | * | 3/1990 | Jonker | 220/612 |
| 4,938,051 | A | | 7/1990 | Duffy et al. | |
| 4,941,584 | A | * | 7/1990 | Bowers et al. | 220/601 |
| 5,012,970 | A | | 5/1991 | Kücherer | |
| 5,025,982 | A | * | 6/1991 | Lisiecki | 229/125.35 |
| 5,086,944 | A | | 2/1992 | Duffy et al. | |
| 5,123,667 | A | | 6/1992 | Stolzman | |
| 5,131,557 | A | | 7/1992 | Stolzman | |
| 5,160,061 | A | | 11/1992 | Stolzman | |
| 5,190,209 | A | | 3/1993 | Gordon et al. | |
| 5,211,304 | A | | 5/1993 | Stolzman | |
| 5,215,207 | A | | 6/1993 | Stolzman | |
| 5,259,526 | A | | 11/1993 | Stolzman | |
| 5,292,026 | A | | 3/1994 | Stolzman | |
| 5,299,707 | A | | 4/1994 | Stolzman | |
| 5,320,237 | A | | 6/1994 | Stolzman | |
| 5,361,928 | A | | 11/1994 | Stolzman | |
| 5,450,681 | A | | 9/1995 | Stolzman | |
| 5,452,748 | A | | 9/1995 | Simmons et al. | |
| 5,458,069 | A | | 10/1995 | Stolzman | |
| 5,503,187 | A | | 4/1996 | Simmons et al. | |
| 5,676,406 | A | | 10/1997 | Simmons et al. | |
| 5,678,735 | A | | 10/1997 | Guglielmini | |
| 5,816,437 | A | | 10/1998 | Lin | |
| 6,019,240 | A | * | 2/2000 | Legeza | 220/321 |
| 6,021,916 | A | | 2/2000 | Stolzman | |
| 6,050,545 | A | | 4/2000 | Stolzman | |
| 6,056,143 | A | | 5/2000 | Stolzman | |
| 6,161,715 | A | | 12/2000 | Stolzman | |
| 6,325,231 | B1 | | 12/2001 | Ketting et al. | |
| 6,497,338 | B1 | | 12/2002 | Stolzman | |
| 7,243,962 | B2 | | 7/2007 | Stolzman | |
| 7,617,967 | B2 | | 11/2009 | Koessendrup | |
| D611,864 | S | | 3/2010 | Solow | |
| 8,235,217 | B2 | | 8/2012 | Stolzman | |
| 8,322,559 | B2 | | 12/2012 | Kuzelka | |
| 8,408,418 | B2 | | 4/2013 | Kuzelka | |
| 2003/0178432 | A1 | * | 9/2003 | Meiland et al. | 220/612 |
| 2004/0069790 | A1 | * | 4/2004 | Alexander et al. | 220/612 |
| 2006/0096985 | A1 | | 5/2006 | Stolzman | |
| 2006/0138141 | A1 | | 6/2006 | Stolzman | |
| 2006/0138142 | A1 | | 6/2006 | Stolzman et al. | |
| 2006/0220395 | A1 | | 10/2006 | Kuzelka | |
| 2008/0308555 | A1 | | 12/2008 | Stolzman et al. | |
| 2009/0152271 | A1 | | 6/2009 | Kuzelka | |
| 2010/0252555 | A1 | * | 10/2010 | Syed | 220/212 |
| 2012/0112476 | A1 | | 5/2012 | Kuzelka | |

FOREIGN PATENT DOCUMENTS

| | | |
|---|---|---|
| EP | 2050682 | 4/2009 |
| GB | 2 331 068 | 5/1999 |
| JP | 02521468 | 10/1996 |
| WO | WO 93/17920 | 8/1993 |

OTHER PUBLICATIONS

U.S. Appl. No. 13/828,766, filed Mar. 14, 2013, Stolzman et al.
International Search Report and Written Opinion for International Application No. PCT/US2013/060178 dated Dec. 16, 2013, 11 pages.

* cited by examiner

CONTAINER WITH SIDEWALL AND CLOSURE

BACKGROUND OF THE INVENTION

The present invention relates generally to the field of relatively large containers such as drums or barrels used for shipping bulk dry and liquid goods. The present invention relates specifically to a drum or container with a fiber sidewall and plastic end closures.

SUMMARY OF THE INVENTION

One embodiment of the shipping drum includes a fibrous cylindrical sidewall. The sidewall extends along a longitudinal axis from a first end to a second end. The cylindrical sidewall has an inner surface and an outer surface. The shipping drum includes a bottom closure formed from plastic. The bottom closure includes inner and outer walls defining a channel configured to receive the second end of the sidewall therein. The shipping drum includes an adhesive coupling the sidewall to the inner and outer walls of the bottom closure such that the bottom closure closes the second end of the cylindrical sidewall. The bottom closure is coupled to the sidewall without the bottom closure penetrating or deforming the outer surface of the sidewall.

Another embodiment of a drum includes a fiberboard cylindrical sidewall surrounding a longitudinal axis and extending from a first end to a second end. The drum includes a plastic bottom closure. The plastic bottom closure includes inner and outer walls defining a channel. The second end of the cylindrical sidewall is located in the channel of the bottom closure. The drum includes a first adhesive located in the channel of the bottom closure. The first adhesive couples the sidewall to the inner and outer walls of the bottom closure. The drum includes a plastic chime. The plastic chime defines a central aperture. The plastic chime includes inner and outer walls. A surface of the inner wall and a surface of the outer wall defines a channel therebetween. A first groove is defined in the surface of the inner wall. The first groove extends around at least a portion of the circumference of the inner wall. A second groove is defined in the surface of the outer wall. The second groove extends around at least a portion of the circumference of the outer wall. The first end of the cylindrical sidewall is located in the channel of the chime. The drum includes a second adhesive located in the channel of the chime. The second adhesive couples the sidewall to the inner and outer walls of the chime.

A method of providing a container includes providing a cylindrical sidewall extending from a first end to a second end along a longitudinal axis. The method includes providing a bottom closure including a first wall and a second wall, the walls defining a channel therebetween. The method includes applying adhesive to at least one of the second end of the sidewall and the channel of the bottom closure. The method includes applying force to at least one of the sidewall and the bottom closure to move the second end of the sidewall into the channel of the bottom closure. The method includes providing a chime including a first wall and a second wall, the walls defining a channel therebetween. The method includes applying adhesive to at least one of the first end of the sidewall and the channel of the chime. The method includes applying force to at least one of the sidewall and the chime to move the first end of the sidewall into the channel of the chime.

A drum includes a high density polyethylene bottom closure including inner and outer walls defining a channel. The drum includes a fiber cylinder having a diameter in the range of 15 to 23 inches. The fiber cylinder extends between a first end which is between 30 and 44 inches from a second end of the cylinder. The first end is located within the channel of the bottom closure. The drum includes a first portion of adhesive which chemically reacts with high density polyethylene prior to curing and when placed in contact with high density polyethylene. The adhesive bonds the first end to the bottom closure within the channel of the bottom closure. The drum includes a high density polyethylene chime defining a central aperture and including inner and outer walls defining a channel therebetween, and discontinuous threads around the periphery of the chime. The drum includes a second portion of adhesive which chemically reacts with high density polyethylene prior to curing and when placed in contact with high density polyethylene. The adhesive bonds the second end to the chime within the channel of the chime.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the figures, embodiments of containers, illustrated as drums or barrels, e.g., for shipping and/or storage, etc., are provided. The structure of the fiber-wall drum disclosed herein is configured to permit relatively large drum capacities. The structure also provides for at least one end closure which has an engagement ring (i.e., chime) which is engaged by a lid to close the respective end of the drum.

The drums may include a sidewall formed from a first material and a closure formed from a second material. In one embodiment, a drum may include a cylindrical sidewall, a bottom closure sealing one end of the sidewall, and a chime coupled to the other end of the sidewall. The chime may provide access to the interior of the drum through the open end of the sidewall opposite the bottom closure. The drum may be filled with a material to be shipped and/or stored. A top closure may be provided. Upon filling the drum, the closure may be applied to the drum to seal the open end of the sidewall.

Figure 1:
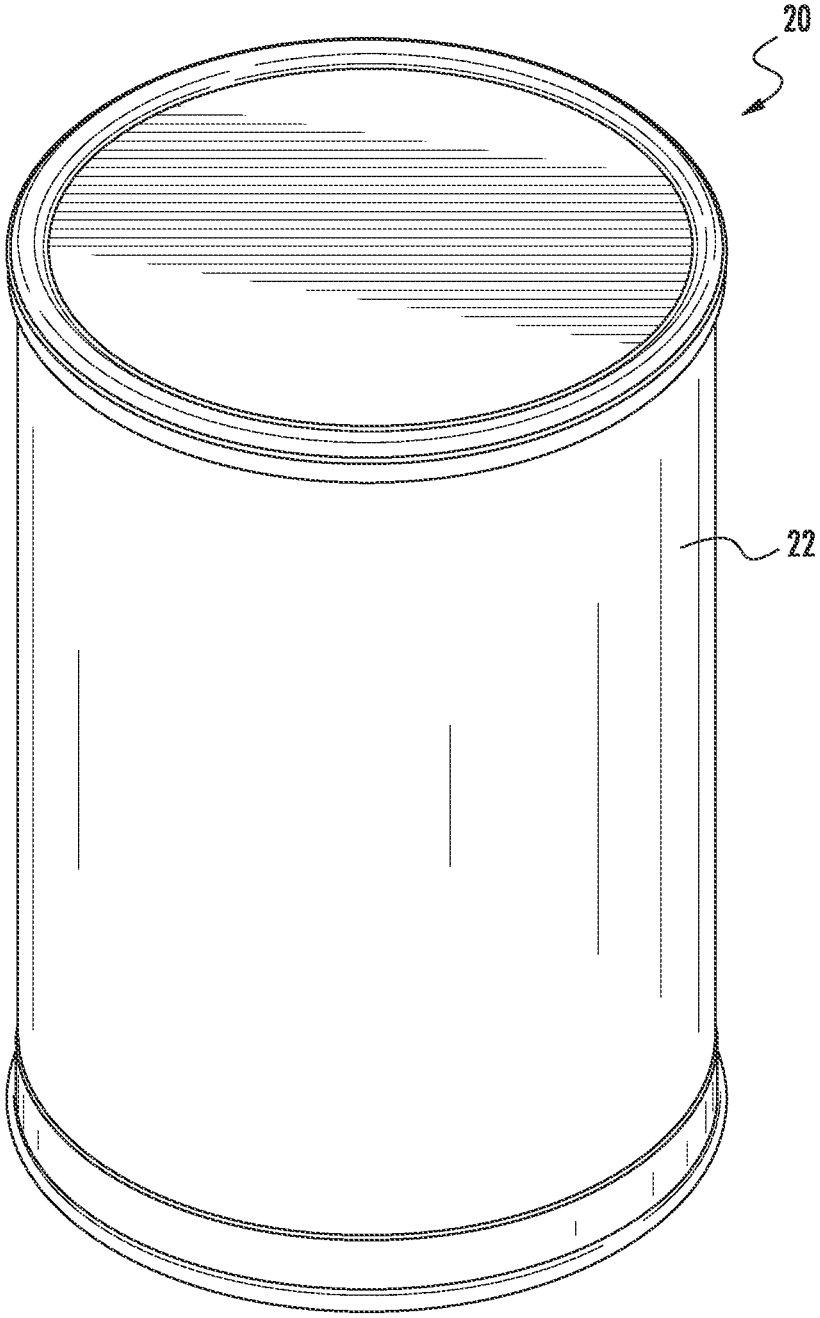
FIG. 1 is a perspective view of an embodiment of a drum.

Referring to FIG. 1, an embodiment of a container, illustrated as a drum 20, is provided. The drum 20 includes a cylindrical sidewall 22. In one embodiment, the sidewall is formed of fibrous material such as, for example, fiberboard.

Figure 2:
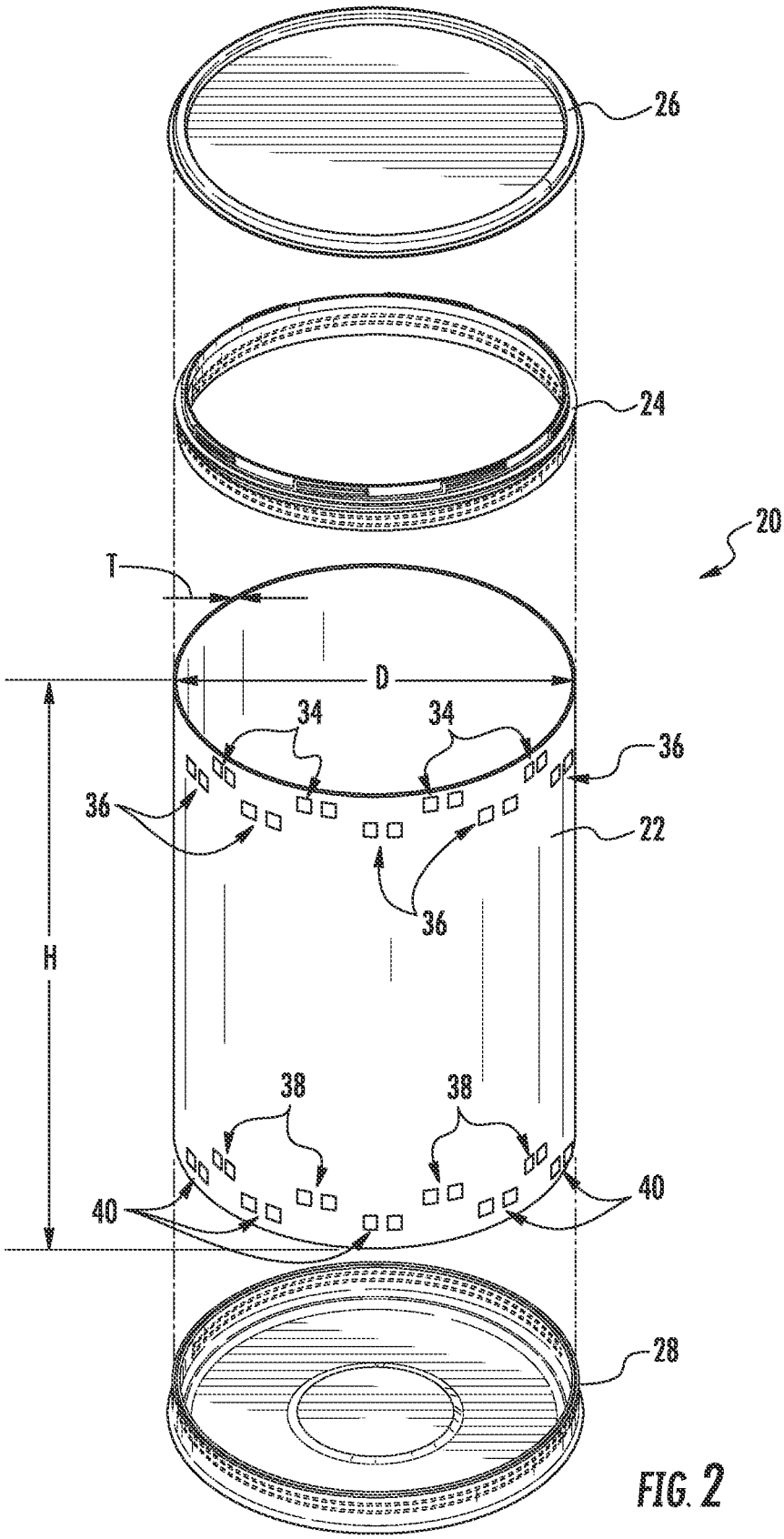
FIG. 2 is an exploded view of an embodiment of a drum.

With reference to FIG. 2, the drum 20 is illustrated in an exploded configuration. In one embodiment, the drum 20 includes a chime 24, a top closure 26, and a bottom closure 28. The sidewall 22 extends from a first end 30 to a second end 32. The bottom closure 28 is configured to be coupled to the second end 32 of the sidewall 22, closing the second end 32 of the sidewall. The chime 24 is configured to be coupled to the first end 30 of the sidewall 22. When the chime 24 is coupled to the first end 30 of the sidewall 22, the first end 30 of the sidewall 22 remains open and material to be placed within the drum 20 may enter through the first end 30 of the sidewall 22 with the chime 24 coupled to the sidewall 30.

As illustrated in FIG. 2, in one embodiment, the sidewall 22 includes a plurality of apertures, illustrated as perforations in FIG. 2, proximate the first end 30. In one embodiment, the sidewall 22 includes a plurality of top upper 34 and lower 36 pairs of square perforations. The top upper 34 and lower 36 pairs of perforations are offset relative to one another both in the direction parallel to longitudinal axis of the sidewall 22 and radially around the circumference of the sidewall 22.

As illustrated in FIG. 2, in one embodiment, the sidewall 22 also includes a plurality of apertures, illustrated as perforations in FIG. 2, proximate the second end 32. In one embodiment, the sidewall 22 includes a plurality of bottom upper 38 and lower 40 pairs of square perforations. The bottom upper 38 and lower 40 pairs of perforations are offset relative to one another both in the direction parallel to the longitudinal axis of the sidewall 22 and radially around the circumference of the sidewall 22.

Figure 2A:
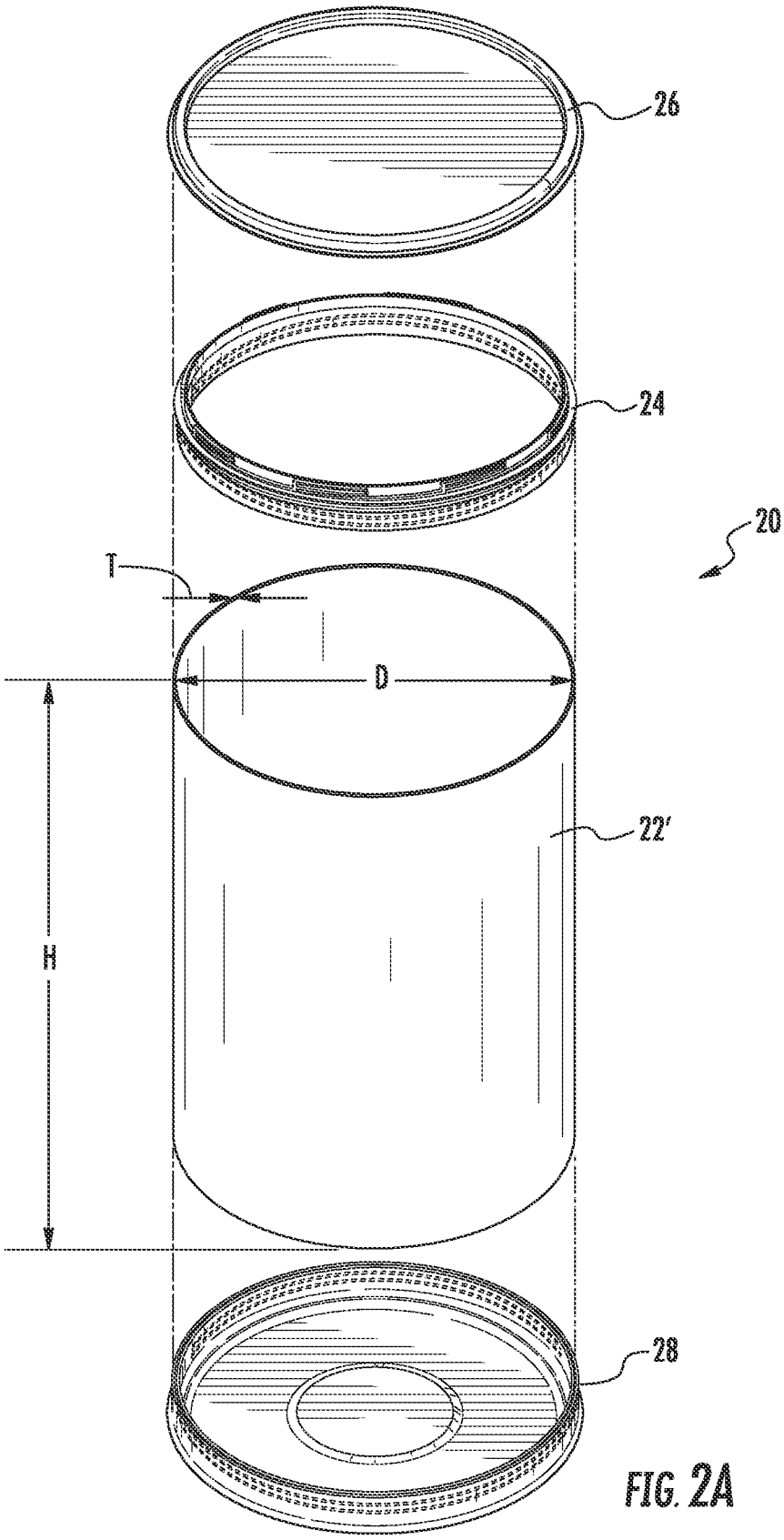
FIG. 2A is an exploded view of another embodiment of a drum.

With reference to FIG. 2A, in another embodiment, the drum 20 includes a continuous sidewall 22', e.g. a sidewall without apertures such as perforations formed in the sidewall 22'.

Figure 3:
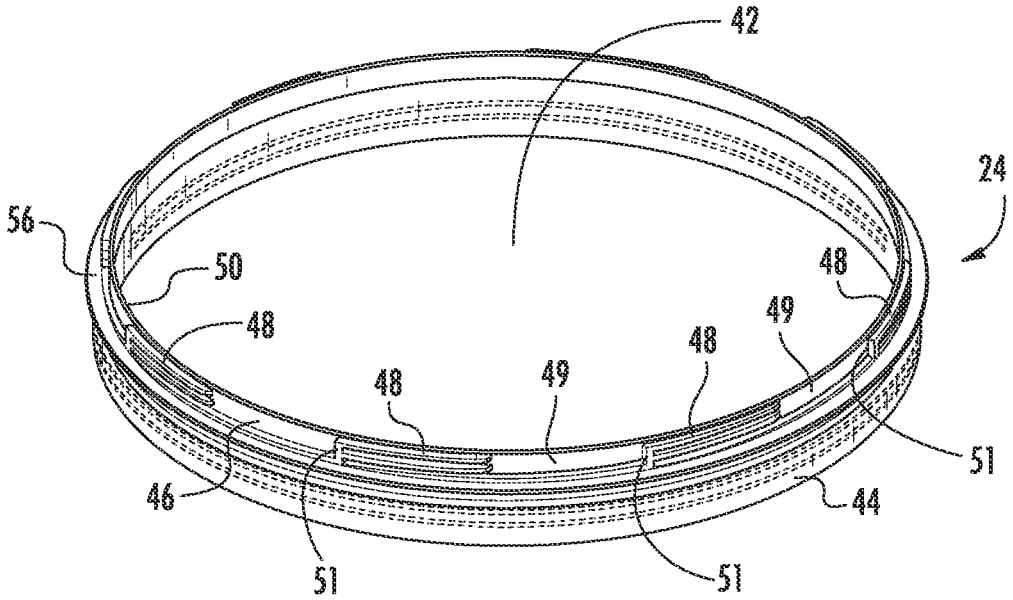
FIG. 3 is a perspective view of an embodiment of a chime.

FIG. 3 illustrates an embodiment of a chime 24. In one embodiment, the chime 24 is generally annular and defines a central aperture 42 through which material may be placed into the drum 20 when the chime 24 is coupled to the sidewall 22. The chime 24 includes a portion 44 configured to be coupled to the sidewall 22 and a portion 46 to which the top closure 26 is configured to be coupled. The portion 46 includes discontinuous threading portions 48, spaced around the circumference of the portion 44, which may be used to couple the top closure 26 to the chime 24, as will be further described below. In one embodiment, the chime 24 includes eight discontinuous threading portions 48 spaced apart equally around the circumference of the chime 24. In other embodiments, the chime 24 may include any other suitable number of discontinuous threading portions 48.

Figure 4:
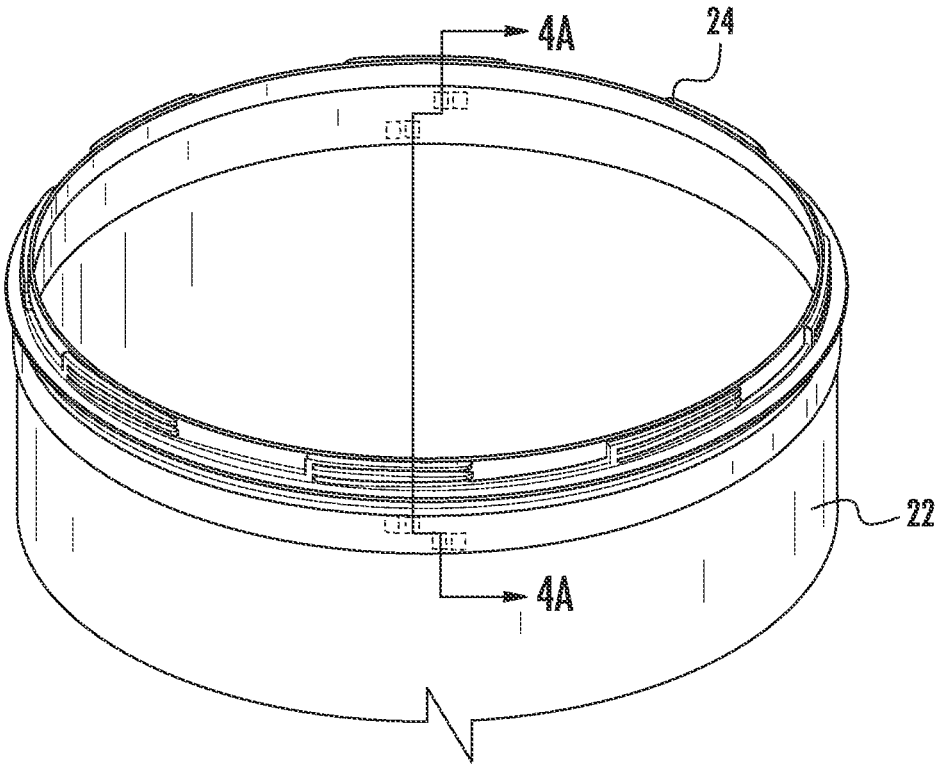
FIG. 4 is a perspective view of an embodiment of a chime coupled to an embodiment of a sidewall.
Figure 4A:
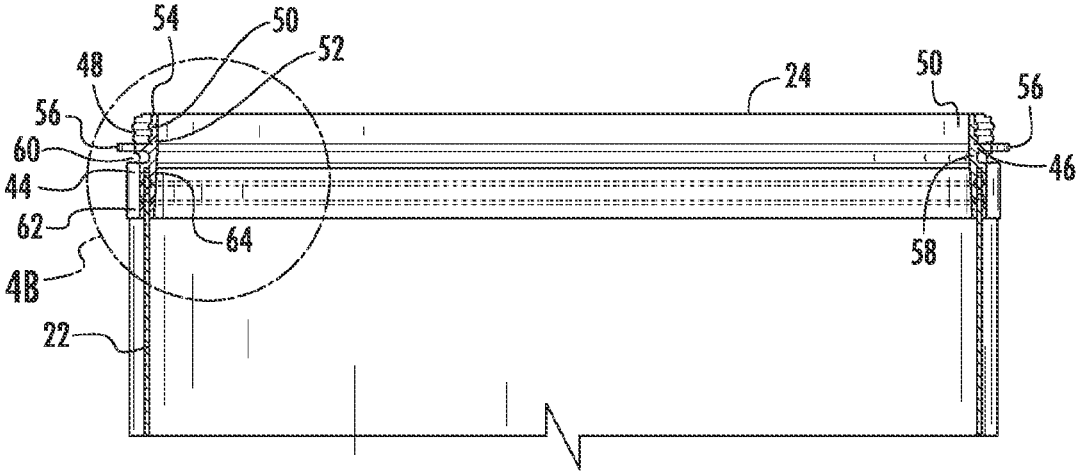
FIG. 4A is a cross-sectional view of the chime coupled to the sidewall of FIG. 4 taken along the line 4A-4A in FIG. 4.
Figure 4B:
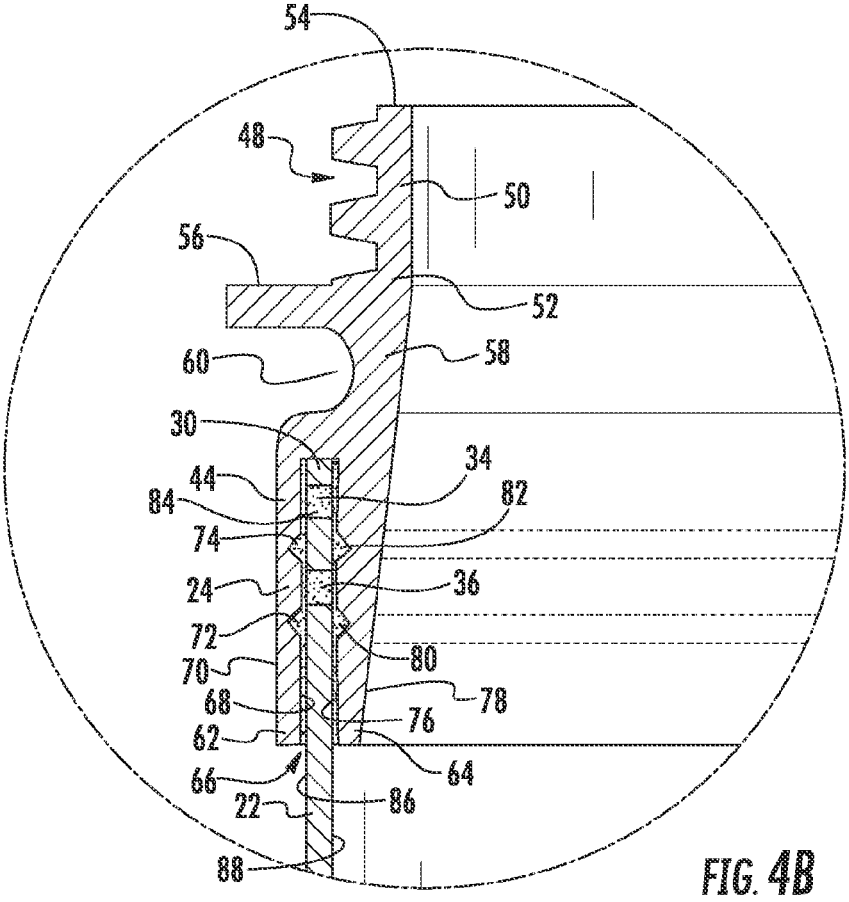
FIG. 4B is a detail view of the area 4B in FIG. 4.

With reference to FIGS. 4, 4A, and 4B, in one embodiment, the portion 46 of the chime 24 to which the top closure 26 is configured to be coupled includes an upwardly extending wall 50 extending from a lower end 52 to an upper end 54. The discontinuous threading 48 is defined on the radially outer surface of the wall 50. Extending radially outwardly from the wall 50 proximate its lower end 52 is a flange 56.

With further reference to FIGS. 4, 4A, and 4B, in one embodiment, extending from the intersection of the flange 56 and the wall 50 is a generally C-shaped connecting portion 58, projecting concave radially inwardly. The connecting portion 58 extends between the portion 46 to which the top closure 26 is configured to be coupled and the portion 44 configured to be coupled to the sidewall 22. The connecting portion 58 and the portions 44 and 46 define a channel 60.

In one embodiment, with the chime 24 coupled to the sidewall 22, the drum 20 may be filled with material, e.g., to be stored and/or transported, etc., the top closure 26 is coupled to the chime 24 to seal the drum 20. In one embodiment, machinery including mechanical fingers may be used to lift and locate the drum 20, e.g., the mechanical fingers may be placed into the channel 60 and upwardly directed force may be applied to the chime 24, and, e.g., the flange 52, to lift and maneuver the drum 20 and its contents.

With further reference to FIGS. 4, 4A, and 4B, in one embodiment, the portion 44 configured to be coupled to the sidewall 22 includes an outer wall 62 and an inner wall 64. The outer and inner walls 62 and 64 extend generally parallel to one another downwardly away from the connecting portion 58 and define between them a channel 66 into which the first end 30 of the sidewall 22 is received.

The outer wall 62 has an inner surface 68 proximate the channel 66 and an outer surface 70 opposite the inner surface 68. Defined in the inner surface 68 are a first groove 72 and a second groove 74 spaced apart from the first groove 72 in a direction parallel with the longitudinal axis of the sidewall 22. The grooves 72 and 74 extend around the circumference of the outer wall 62 in the inner surface 68.

The inner wall 64 has a first surface 76 proximate the channel 66 and a second surface 78 opposite the first surface 76 and distal from the channel 66. The first surface 76 of the inner wall 64 includes a first groove 80 and a second groove 82 spaced apart from the first groove 80 in a direction parallel with the longitudinal axis of the sidewall 22. The grooves 80 and 82 extend around the circumference of the inner wall 64 in the first surface 76.

As is illustrated in FIG. 4A, the sidewall 22 is coupled to chime 24 with adhesive 84. In one embodiment, the adhesive 84 extends from the grooves 72 and 74 and the inner surface 68 of the outer wall 62 to the outer surface 86 of the sidewall 22, through the top upper 34 and lower 36 perforations in the sidewall 22 to the inner surface 88 of the sidewall 22 to the first surface 76 and grooves 80 and 82 of the inner wall 64. Thus, the sidewall 22 is coupled to both the inner surface 68 of the outer wall 62 and the first surface 76 of the inner wall 64. The sidewall 22 is retained in the channel 66 by the adhesive 84.

As is illustrated in FIGS. 4A and 4B, in one embodiment, when viewed in cross-section, the grooves 72, 74, 80, and 82 have a generally triangular shape.

Figure 4C:
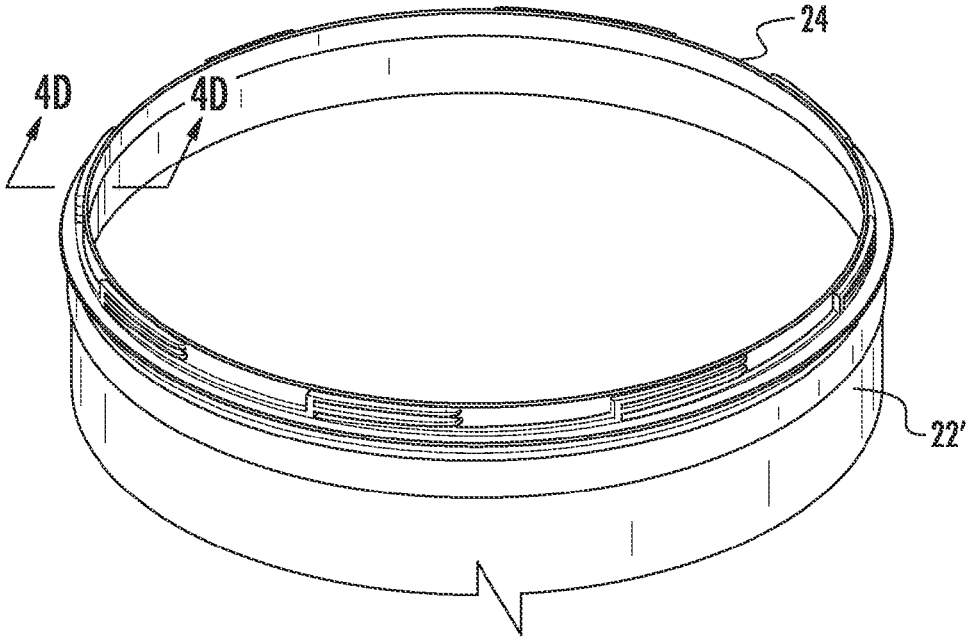
FIG. 4C is a perspective view of another embodiment of a chime coupled to another embodiment of a sidewall.
Figure 4D:
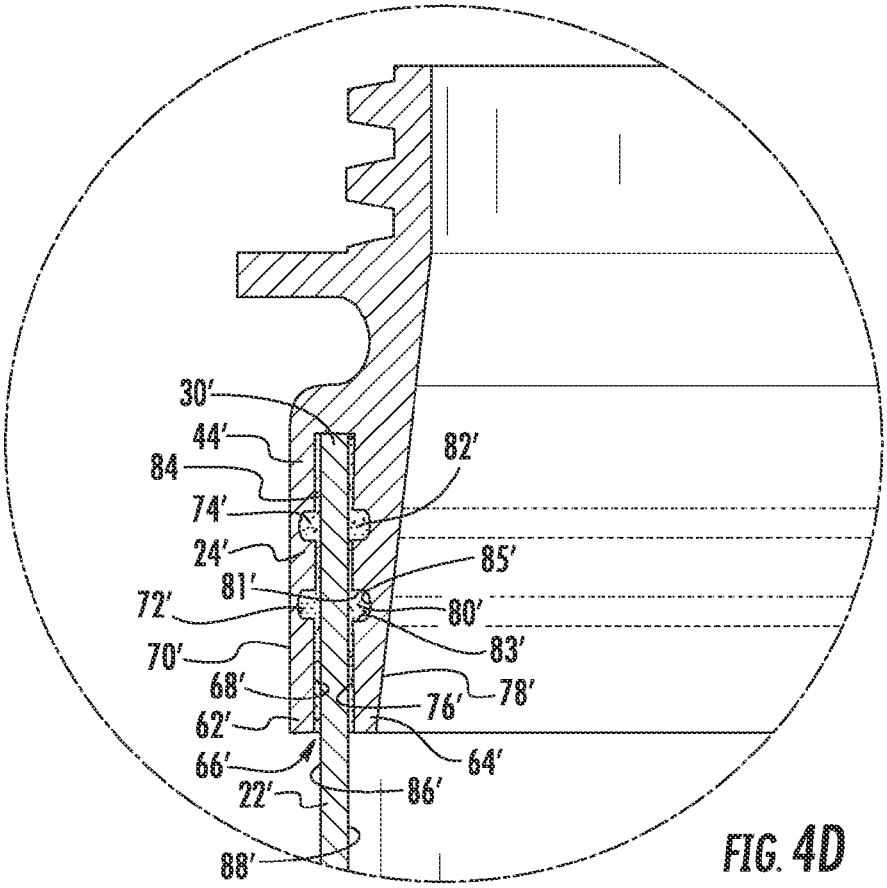
FIG. 4D is a cross-sectional view of the chime coupled to the sidewall of FIG. 4C taken along the line 4D-4D in FIG. 4C.

With reference to FIGS. 4C and 4D, another embodiment of a chime 24' coupled to a continuous sidewall 22' is illustrated. The chime 24' has some features similar to the chime 24; some differences between the chime 24' and chime 24 are discussed.

In one embodiment, chime 24' includes grooves 72' and 74' defined in the inner surface 68' of the outer wall 62'. The chime 24' also includes grooves 80' and 82' defined in the first surface 76' of the inner wall 64'. Groove 80' is defined by an upper portion 81' of the first surface 76' that extends generally perpendicularly away from the sidewall 22', a lower portion 83' that extends generally parallel with the upper portion 81' generally perpendicularly away from the sidewall 22' and a rounded portion 85' extending between the upper portion 81' and the lower portion 83'. The grooves 72', 74', and 82' are shaped similarly to the groove 80', as illustrated in FIGS. 4C and 4D.

Figure 4E:
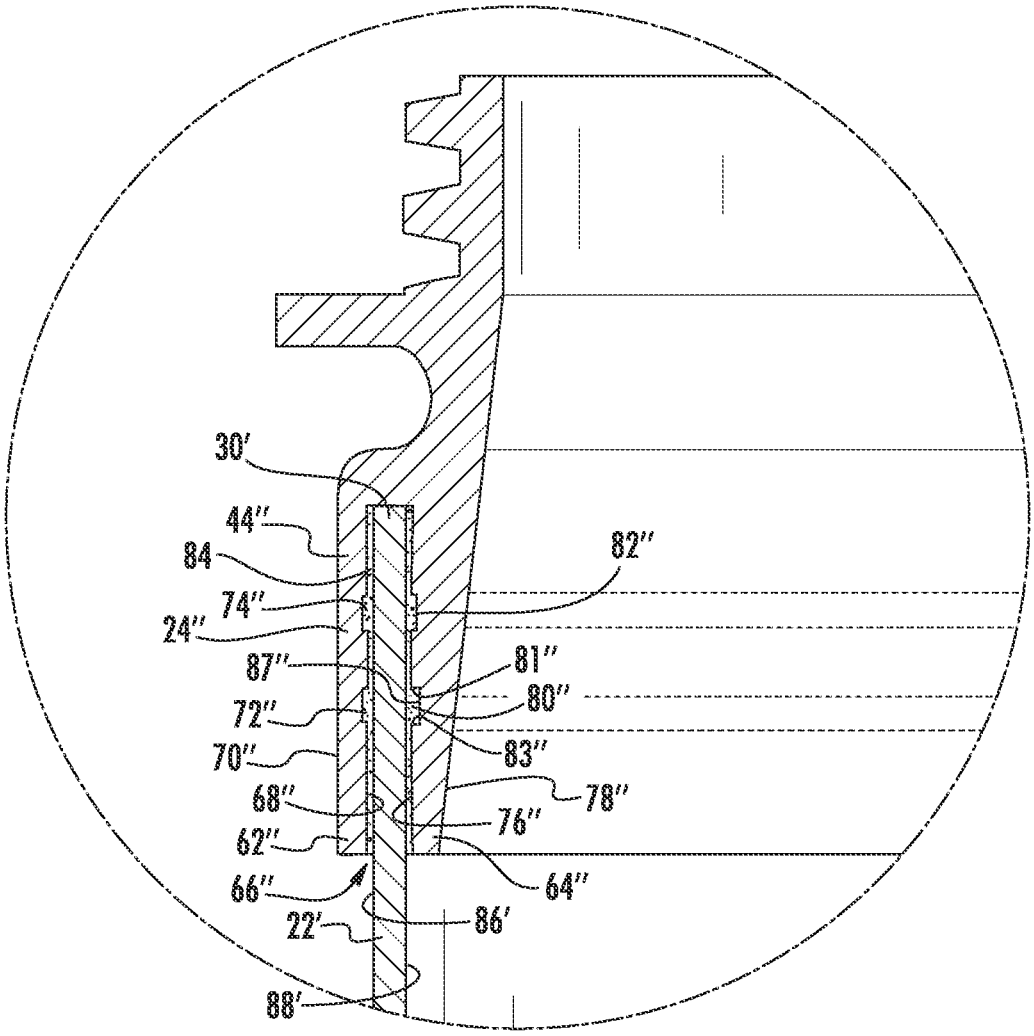
FIG. 4E is a detail cross-sectional view of another embodiment of a chime coupled to another embodiment of a sidewall.

With reference to FIG. 4E, another embodiment of a chime 24" includes grooves 72" and 74" defined in the inner surface 68" of the outer wall 62" and grooves 80" and 82" defined in the first surface 76" of the inner wall 64". Groove 80" is defined by an upper portion 81" of the first surface 76" that extends generally perpendicularly away from the sidewall 22', a lower portion 83" that extends generally parallel with the upper portion 81" generally perpendicularly away from the sidewall 22', and a portion 87" that extends generally parallel with the sidewall 22' between the upper portion 81" and the lower portion 83". The grooves 72", 74", and 82" are shaped similarly to the groove 80", as illustrated in FIG. 4E.

In one embodiment, the upper and lower portions 81" and 83" extend a shorter distance that the upper and lower portions 81' and 83' illustrated in FIGS. 4C and 4D. Thus, in the illustrated embodiment, the groove 80" is less deep than the groove 80' illustrated in FIGS. 4C and 4D. In other embodiments, other suitable depths, shapes, dimensions, etc. for grooves may be used.

Adhesive 84 is deposited in the channel 66, 66', 66" and extends into the grooves 72, 72', 72", 74, 74', 74", 80, 80', 80", 82, 82', and 82", where, upon curing, the adhesive 84 is in contact with the bottom portions of the grooves and resists displacement of the sidewall 22, 22' downwardly away from the chime 24, 24', 24".

In the embodiments illustrated in FIGS. 4D and 4E, the portions of the adhesive 84 extending into the grooves 72', 72", 74', 74", 80', 80", 82', and 82" contact the lower portions of the grooves extending generally perpendicularly away from the sidewall 22'. Thus, in some embodiments, grooves may provide additional surface area to which the adhesive 84 may bond and a shape of the cured adhesive such that portions of the adhesive 84 in the grooves are shaped to resist displacement of the sidewall 22' away from the chime 24', 24".

Figure 4F:
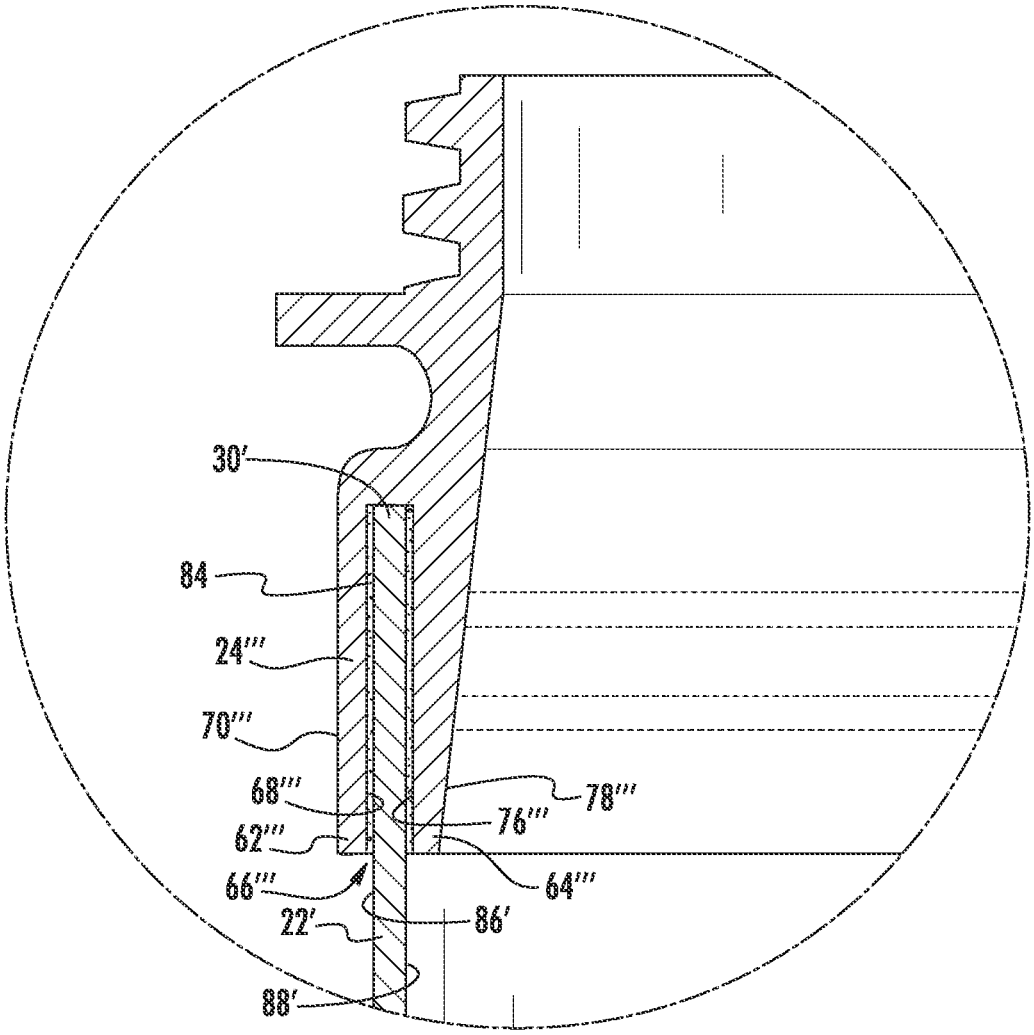
FIG. 4F is a detail cross-sectional view of another embodiment of a chime coupled to another embodiment of a sidewall.

With reference to FIG. 4F, in another embodiment, the inner surface 68" of the outer wall 62" and the first surface 76" of the inner wall 64" are generally flat and do not include grooves.

Figure 5:
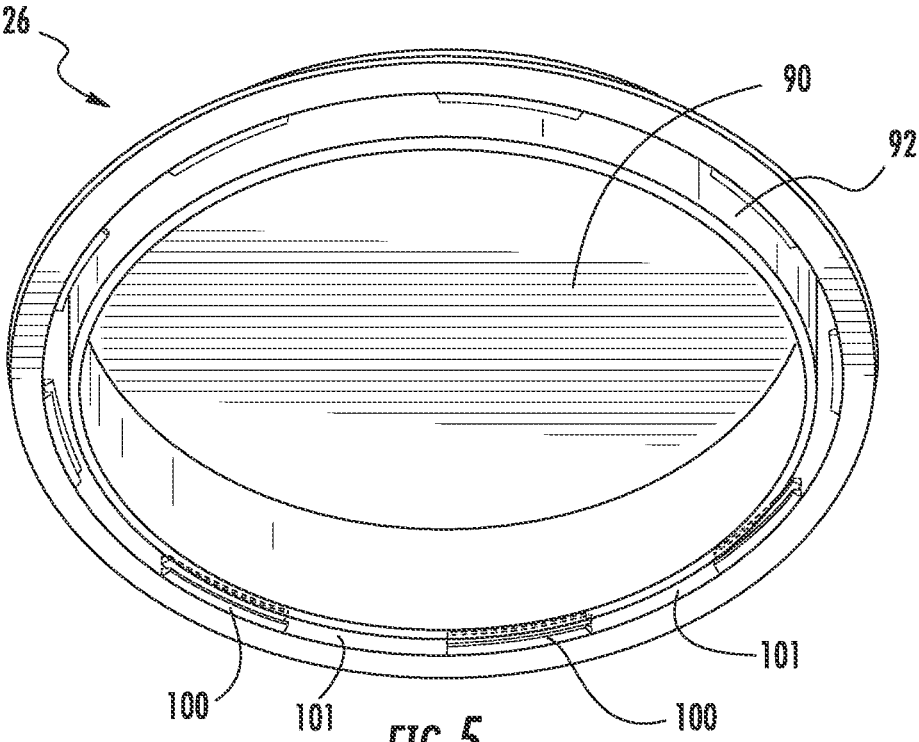
FIG. 5 is a bottom perspective view of an embodiment of a top closure.
Figure 5A:
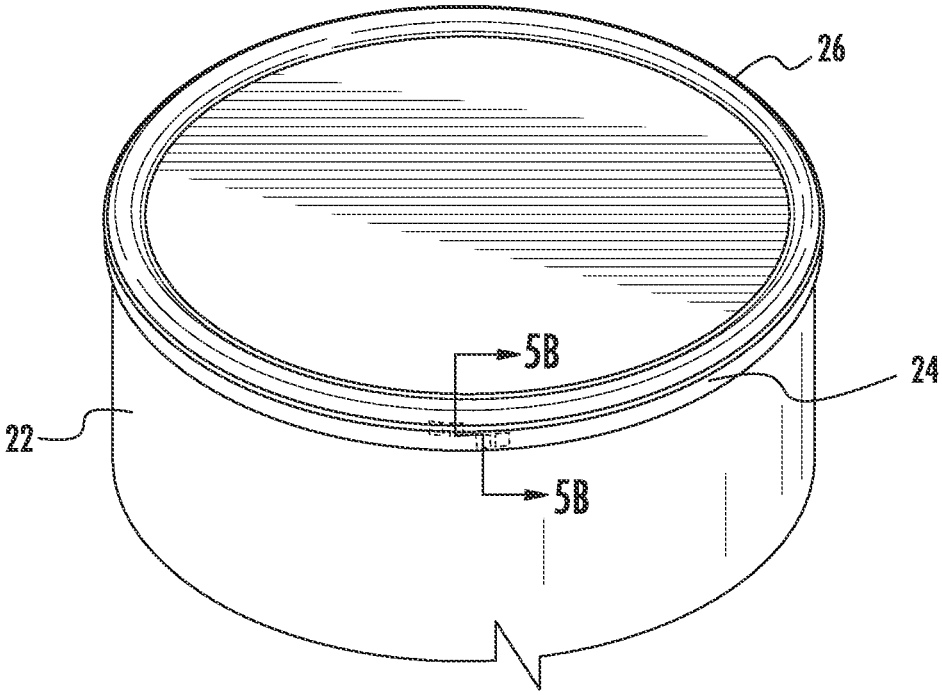
FIG. 5A is a perspective view of an embodiment of a top closure coupled to an embodiment of a chime.
Figure 5B:
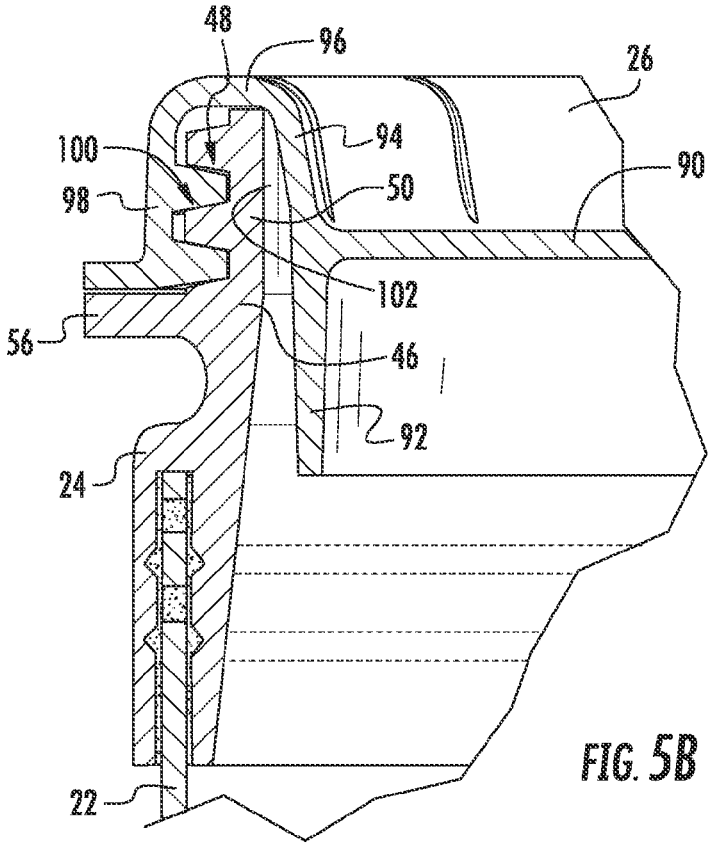
FIG. 5B is a cross-sectional detail view taken along the line 5B-5B in FIG. 5A illustrating coupling of an embodiment of a top closure to an embodiment of a chime.

With reference to FIGS. 5, 5A, and 5B, an embodiment of the top closure 26 is illustrated. The top closure 26 includes a central, generally disc-shaped portion 90. Proximate the radial periphery of the disc-shaped portion 90, the top closure 26 includes a downwardly extending rib 92. The rib 92 may act as a stiffening rib. With reference to FIG. 5B, the top closure 26 also includes an upwardly extending wall portion 94 extending from the disc-shaped portion 90 proximate its radial periphery. The top closure 26 also includes a radially outwardly projecting portion 96 extending from the wall portion 94 distal from the disc-shaped portion 90.

The top closure 26 also includes a downwardly projecting wall portion 98 extending downwardly from the radially outwardly projecting portion 96 distal from the wall portion 94. The interior surface of the downwardly projecting wall portion 98 includes discontinuous threading portions 100. The discontinuous threading portions 100 are configured to interact with the discontinuous threading portions 48 of the portion 46 of the chime 24 to couple the top closure 26 to the chime 24. The wall portion 94, the radially outwardly projecting portion 96, and the downwardly projecting wall portion 98 define a channel 102.

In one embodiment, to attach the top closure 26 to the chime 24, the top closure 26 is located to place the wall portion 50 of the chime 24 in the channel 102 of the top closure 26. The top closure 26 is rotated about the longitudinal axis of the sidewall 22 to bring the discontinuous threading portions 100 of the top closure 26 into engagement with the discontinuous threading 48 of the chime 24, with the engaged threading portions 48 and 100 coupling the top closure 26 to the chime 24.

In one embodiment, the discontinuous threading portions 48 and 100 are configured such that the top closure 26 may be rotated about the longitudinal axis of the sidewall 22 less than approximately 360 degrees to fully engage the discontinuous threading portions 48 and 100 to secure the top closure 26 to the chime 24. Additionally, in one embodiment, the chime 24 and the top closure 26 may be formed by molding. In one embodiment, the discontinuous threading portions 48 and 100 are configured such that the chime 24 and the top closure 26 may be rotated relative to the molds less than 360 degrees to remove the chime 24 and the top closure 26 from the molds.

Figure 6:
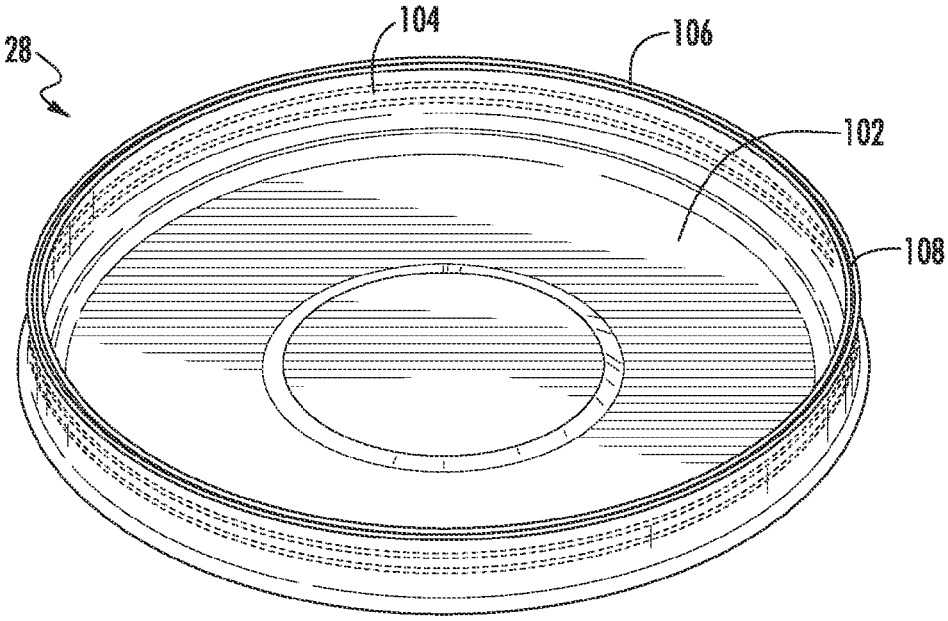
FIG. 6 is a perspective view of an embodiment of a bottom closure.

An embodiment of a bottom closure 28 is illustrated in FIG. 6. The bottom closure 28 includes a central disc-shaped portion 102, an inner wall 104 extending upwardly from the disc-shaped portion 102 proximate its radial periphery, and an outer wall 106 spaced apart from the inner wall 104 and extending upwardly from the disc-shaped portion 102 proximate its radial periphery. The inner and outer walls 104 and 106 define a channel 108 between them.

Figure 7:
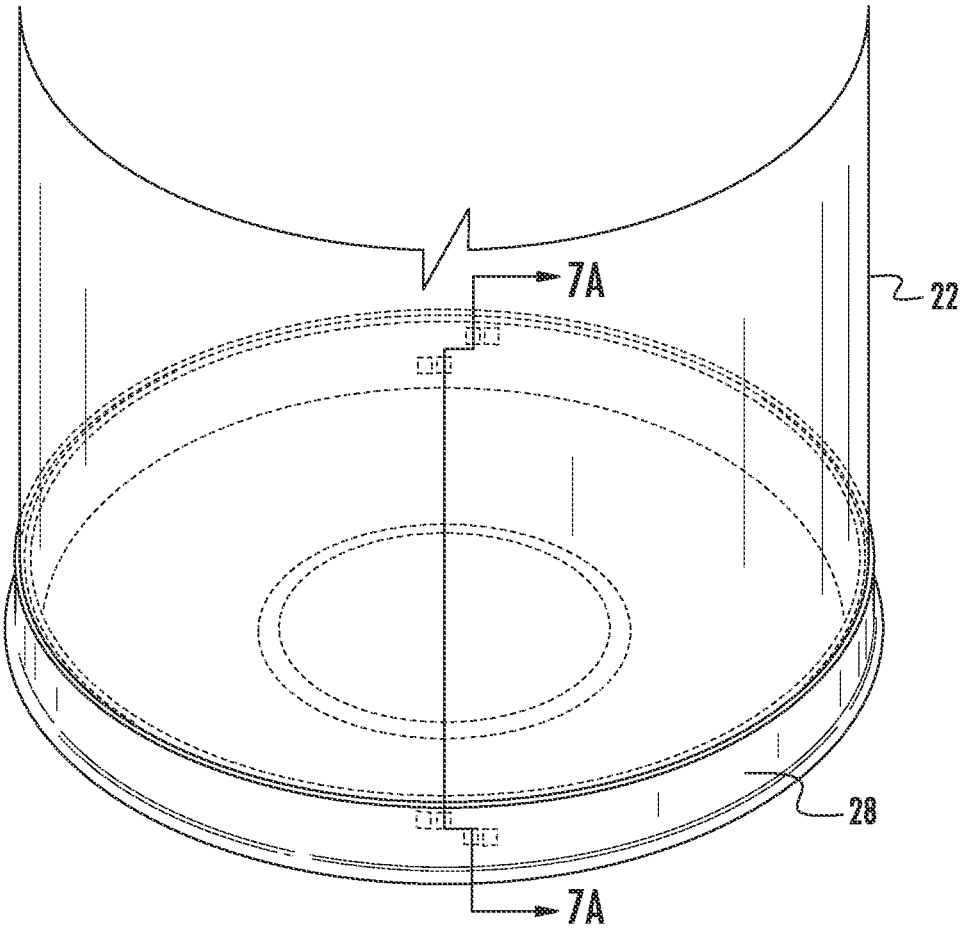
FIG. 7 is a perspective view of an embodiment of a bottom closure coupled to an embodiment of a sidewall.
Figure 7A:
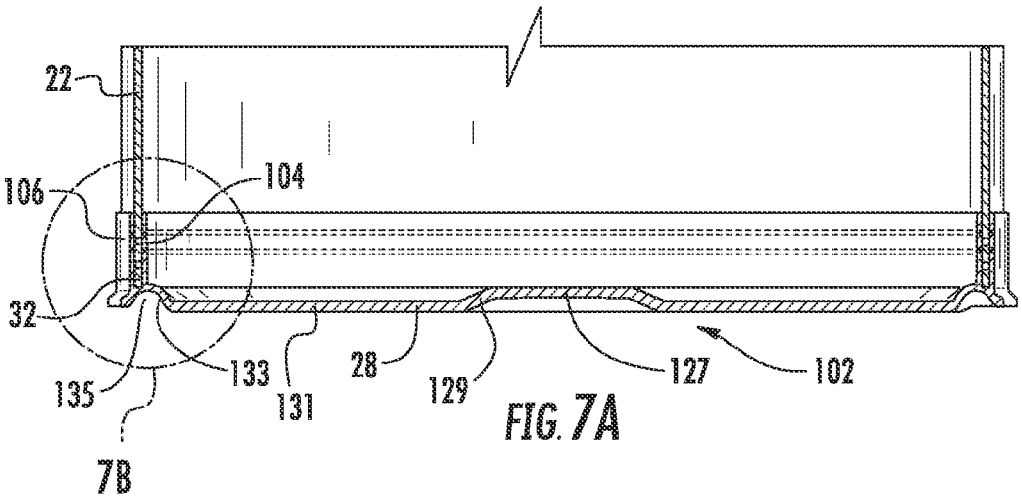
FIG. 7A is a cross-sectional view of an embodiment of a bottom closure coupled to an embodiment of a sidewall taken along the line 7A-7A in FIG. 7.
Figure 7B:
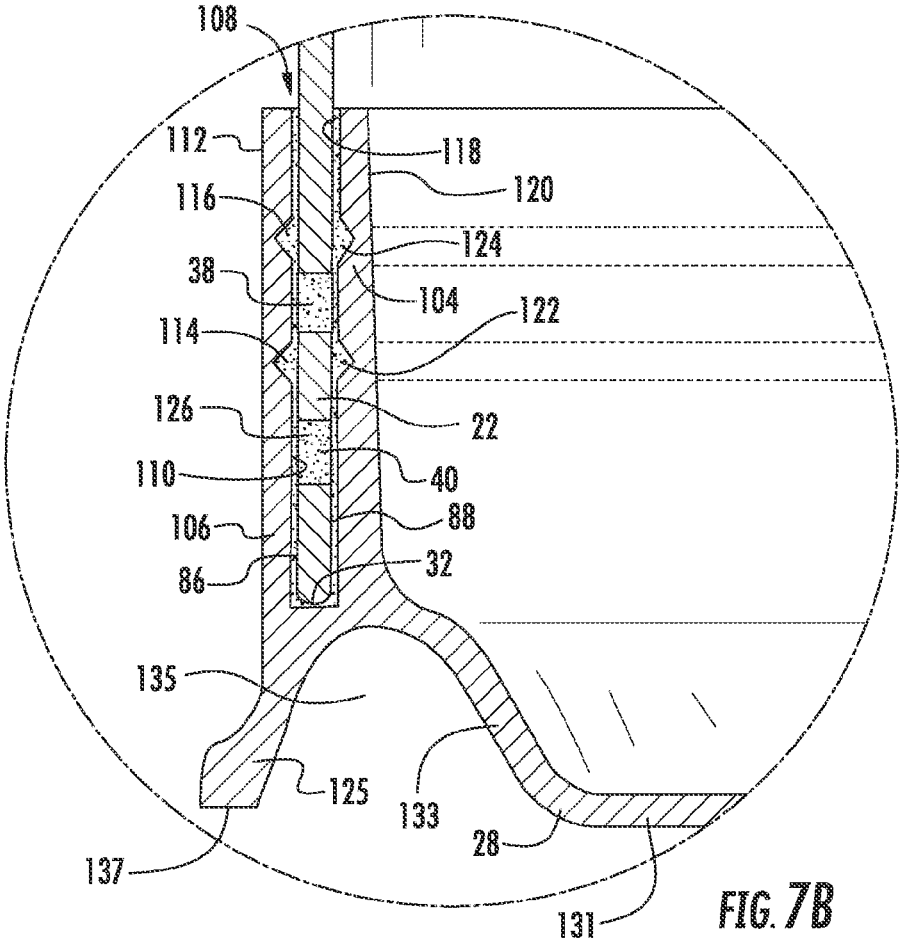
FIG. 7B is a detail view of the area 7B in FIG. 7A.

With reference to FIGS. 7A and 7B, in one embodiment, the second end 32 of the sidewall 22 is located in the channel 108. As illustrated in FIG. 7B, the outer wall 106 has an inner surface 110 proximate the channel 108 and an outer surface 112 distal from the channel 108. Defined in the inner surface 110 are a first groove 114 and a second groove 116. The first and second grooves 114 and 116 are spaced apart in a direction parallel with the longitudinal axis of the sidewall 22 and extend in the inner surface 110 around the circumference of the outer wall 106.

With further reference to FIGS. 7A and 7B, in one embodiment, the inner wall 104 of the bottom closure 28 includes a first surface 118 proximate the channel 108 and a second surface 120 opposite the first surface 118. Defined in the first surface 118 are a first groove 122 and a second groove 124. The first and second grooves 122 and 124 are spaced apart in a direction parallel with the longitudinal axis of the sidewall 22 and extend around the circumference of the inner wall 104 in the first surface 118. In one embodiment, the grooves 114, 116, 122, and 124, when viewed in cross-section, are generally triangularly shaped, as illustrated in FIG. 7B.

With further reference to FIG. 7B, in one embodiment, the sidewall 22 is coupled to bottom closure 28 with adhesive 126. In one embodiment, the adhesive 126 extends from the grooves 114 and 116 and the inner surface 110 of the outer wall 106 to the outer surface 86 of the sidewall 22, through the upper 38 and lower 40 perforations in the sidewall 22 to the inner surface 88 of the sidewall 22 and to the first surface 118 and grooves 122 and 124 of the inner wall 104. Thus, the sidewall 22 is coupled to both the inner surface 110 of the outer wall 106 of the bottom closure 28 and the first surface 118 of the inner wall 104 of the bottom closure 28. In one embodiment, when the adhesive 126 is cured, the sidewall 22 is retained in the channel 66 by the adhesive 126.

In one embodiment, the adhesive 126 coupling the bottom closure 28 to the may be the same type of adhesive as the adhesive 84 coupling the chime 24 to the sidewall 22. In other embodiments, the adhesive 126 and the adhesive 84 may be different types of adhesive.

In one embodiment, the bottom closure 28 also includes a flange 125 extending downwardly away from the inner and outer walls 104 and 106. In one embodiment, the flange 125 terminates short of the bottom of the central disc-shaped portion 102 in the direction parallel to the longitudinal axis of the sidewall 22.

With reference to FIG. 7A, in one embodiment, the central portion 102 includes a raised central portion 127. Extending from the raised central portion 127 proximate its radial periphery is a downwardly angled portion 129. The downwardly angled portion 129 extends between the raised central portion 127 and an outer portion 131. The outer portion 131 extends radially outwardly from the angled portion 129 to an outer upwardly extending portion 133. The outer upwardly extending portion 133 extends upwardly and radially outwardly from the outer portion 131 inner wall 104. In one embodiment, the lower axial periphery of the outer portion 131 is located lower than the peripheral end 137 of the flange 125. In one embodiment, the flange 125 and the outer upwardly extending portion 133 define a channel 135. The flange 125 is configured such that the channel 135 may be accessed, for example, by a moving apparatus, user's hand, etc., underneath the peripheral end 137 of the flange 125.

Figure 7C:
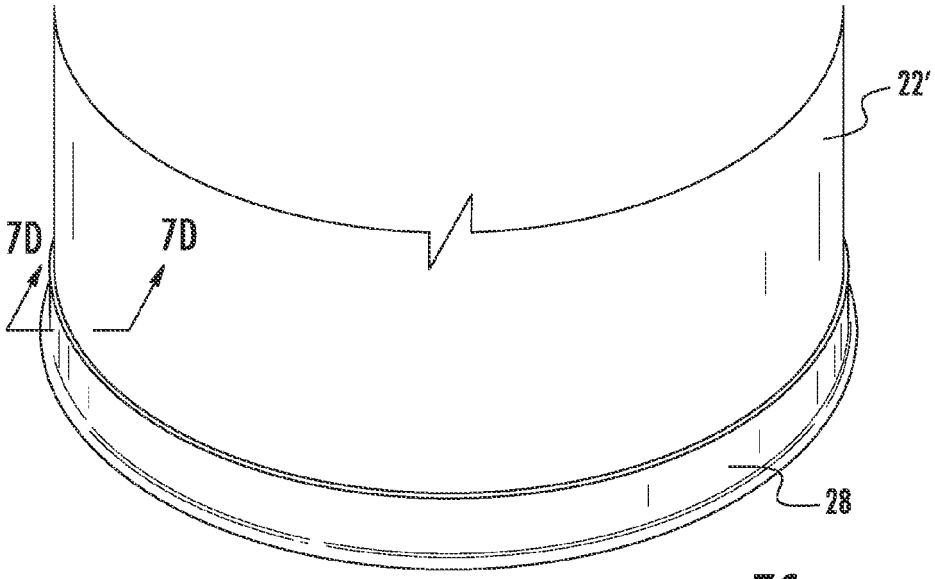
FIG. 7C is a perspective view of an embodiment of a bottom closure coupled to another embodiment of a sidewall.
Figure 7D:
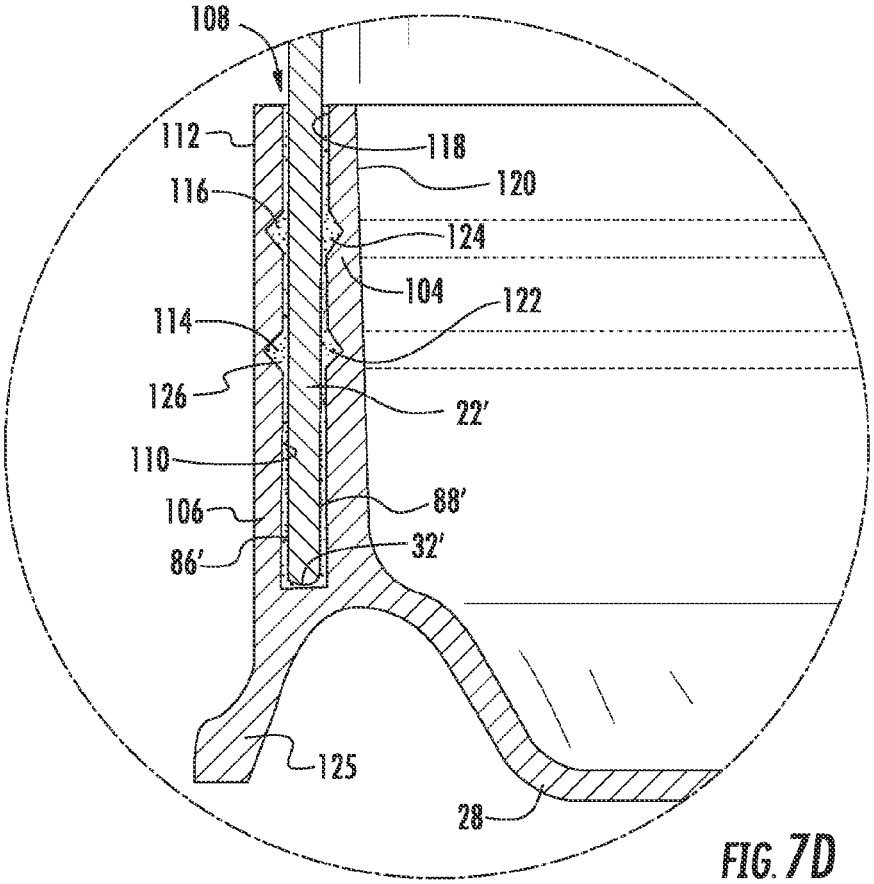
FIG. 7D is a detail cross-sectional view of the bottom closure coupled to the sidewall illustrated in FIG. 7C taken along the line 7D-7D in FIG. 7C.

FIGS. 7C and 7D illustrate another embodiment of a continuous sidewall 22', e.g., without apertures, perforations, etc., coupled to an embodiment of a bottom closure 28. The portion of the sidewall 22' located in the channel 108 is continuous and does not include apertures or perforations.

Figure 7E:
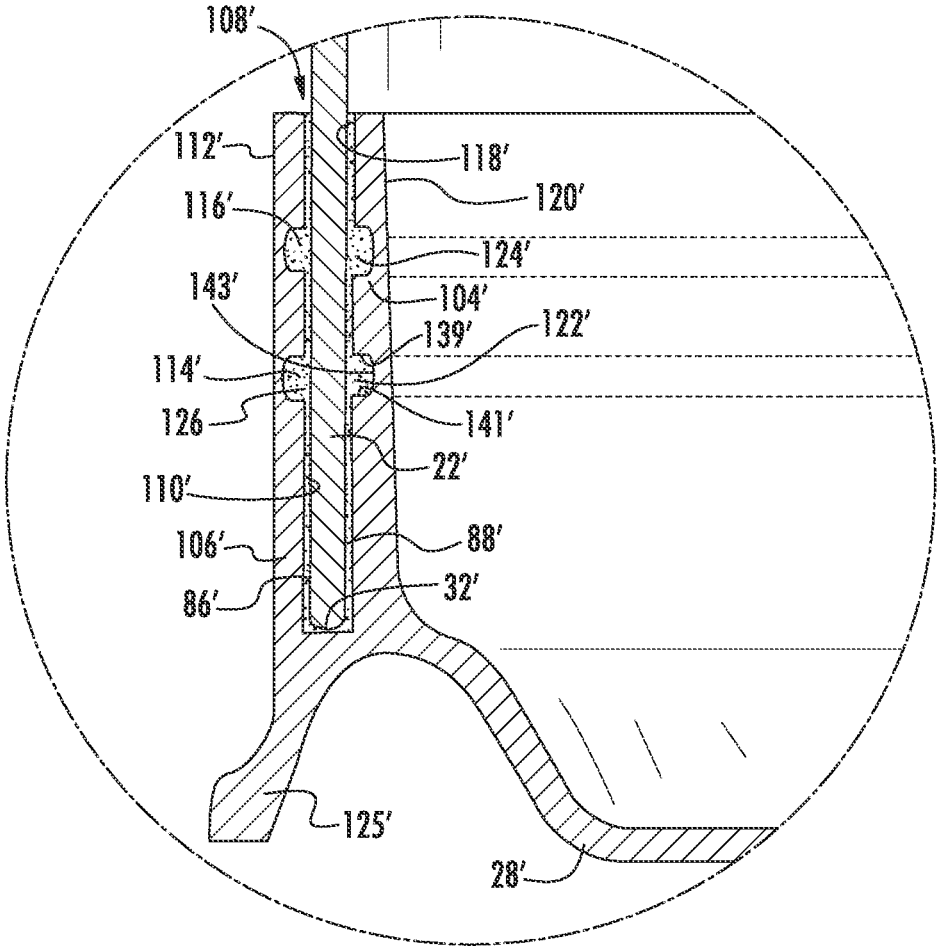
FIG. 7E is a detail cross-sectional view of another embodiment of a bottom closure coupled to an embodiment of a sidewall.

FIG. 7E illustrates another embodiment of a bottom closure 28' coupled to a continuous sidewall 22'. The grooves 114', 116', 122', and 124' in the bottom closure 28' are shaped differently than the grooves in other embodiments of bottom closures described above.

In one embodiment, the bottom closure 28' includes grooves 114' and 116' defined in the inner surface 110' of the outer wall 106'. The bottom closure 28' also includes grooves 122' and 124' defined in the first surface 118' of the inner wall 104'. Groove 122' is defined by an upper portion 139' of the first surface 118' that extends generally perpendicularly away from the sidewall 22', a lower portion 141' that extends generally parallel with the upper portion 139' generally perpendicularly away from the sidewall 22' and a rounded portion 143' extending between the upper portion 139' and the lower portion 141'. In one embodiment, the grooves 114', 116', and 124' are shaped similarly to the groove 122', as illustrated in FIG. 7E.

Figure 7F:
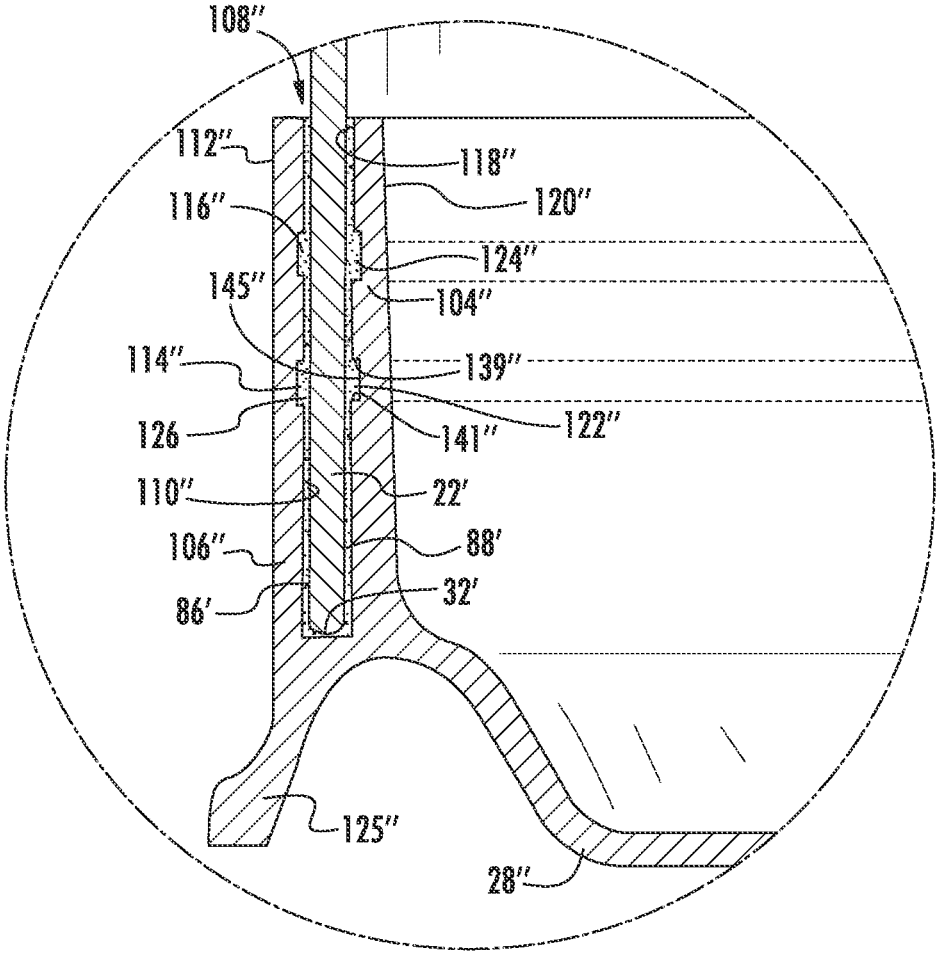
FIG. 7F is a detail cross-sectional view of another embodiment of a bottom closure coupled to an embodiment of a sidewall.

With reference to FIG. 7F, another embodiment of a bottom closure 28" includes grooves 114" and 116" defined in the inner surface 110" of the outer wall 106" and grooves 122" and 124" defined in the first surface 118" of the inner wall 104". Groove 122" is defined by an upper portion 139" of the first surface 118" that extends generally perpendicularly away from the sidewall 22', a lower portion 141" that extends generally parallel with the upper portion 139" generally perpendicularly away from the sidewall 22', and a portion 145" that extends generally parallel with the sidewall 22' between the upper portion 139" and the lower portion 141". The grooves 114", 116", and 124" are shaped similarly to the groove 122", as illustrated in FIG. 7F.

In one embodiment, the upper and lower portions 139" and 141" extend a shorter distance that the upper and lower portions 139' and 141' illustrated in FIGS. 4C and 4D. Thus, in the illustrated embodiment, the groove 80" is less deep than the groove 80' illustrated in FIG. 4E. In other embodiments, other suitable depths, shapes, dimensions, etc. for grooves may be used.

Adhesive 126 is deposited in the channel 108, 108', 108" and extends into the grooves 114, 114', 114", 116, 116', 116", 122, 122', 122", 124, 124', and 124", where, upon curing, the adhesive 126 is in contact with the bottom portions of the grooves and resists displacement of the sidewall 22, 22' upwardly away from the bottom closure 28, 28', 28".

In the embodiments illustrated in FIGS. 7E and 7F, the portions of the adhesive 126 extending into the grooves 114', 114", 116', 116", 122', 122", 124', and 124" contact the upper portions of the grooves extending generally perpendicularly away from the sidewall 22'. Thus, in some embodiments, grooves may provide additional surface area to which the adhesive 126 may bond and a shape of the cured adhesive such that portions of the adhesive 126 in the grooves are shaped and extend into the grooves to resist displacement of the sidewall 22' away from the bottom closure 28' and 28" or out of the channel 108' and 108".

Figure 7G:
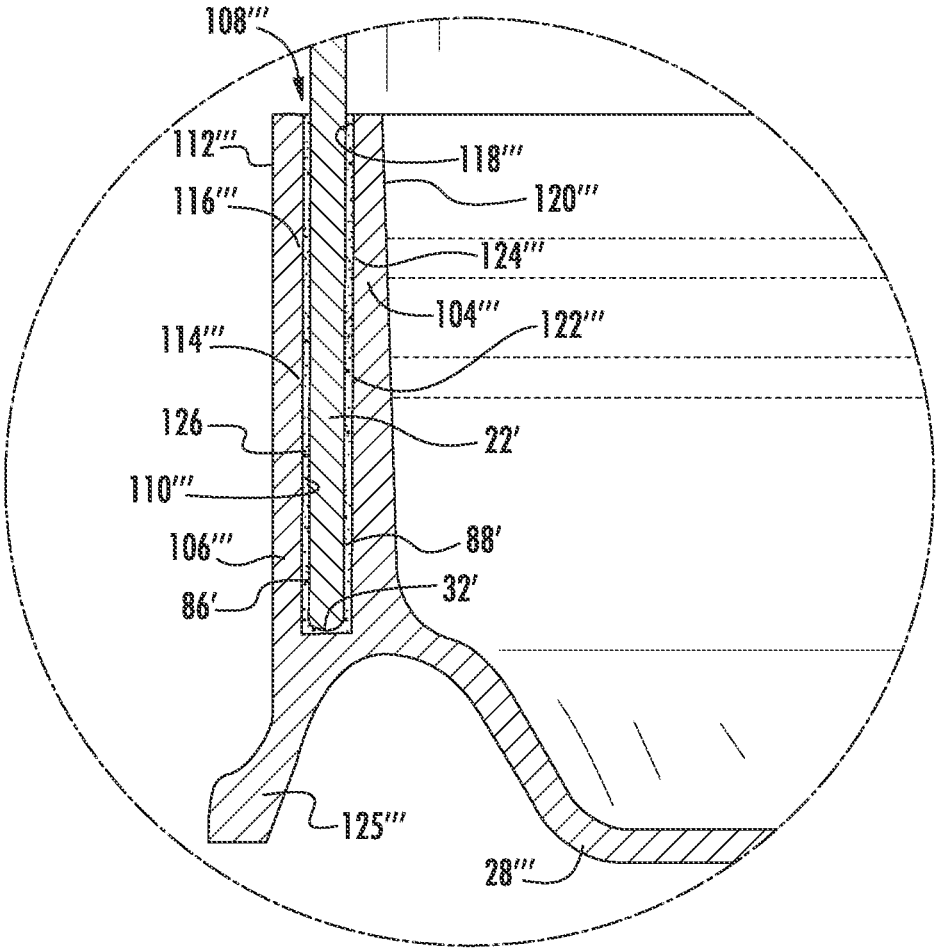
FIG. 7G is a detail cross-sectional view of another embodiment of a bottom closure coupled to an embodiment of a sidewall.

With reference to FIG. 7G, in another embodiment, the inner surface 110''' of the outer wall 106''' and the first surface 118''' of the inner wall 104''' are generally flat and do not include grooves.

With reference to FIG. 2, the sidewall 22 has a height H. In one embodiment, the height H is between approximately 15 inches and approximately 44 inches. In another embodiment, the height H is between approximately 33 inches and approximately 41 inches. In another embodiment, the height H is approximately 37 inches.

With reference to FIG. 2A, the sidewall 22' has a height H. In one embodiment, the height H is between approximately 15 inches and approximately 44 inches. In another embodiment, the height H is between approximately 33 inches and approximately 41 inches. In another embodiment, the height H is approximately 37 inches.

With further reference to FIG. 2, the sidewall 22 has a diameter, shown in the illustrated embodiment as an inner diameter D. In one embodiment, the diameter D is between approximately 10 inches and approximately 30 inches. In another embodiment, the diameter D is between approximately 15.5 inches and approximately 23 inches. In one embodiment, the diameter D is approximately 15.5 inches. In another embodiment, the diameter D is approximately 17 inches. In another embodiment, the diameter D is approximately 18.5 inches. In another embodiment, the diameter D is approximately 20 inches. In another embodiment, the diameter is approximately 21.5 inches. In another embodiment, the height is approximately 23 inches. In other embodiments, the diameter may be an outer diameter.

With further reference to FIG. 2A, the sidewall 22' has a diameter, shown in the illustrated embodiment as an inner diameter D. In one embodiment, the diameter D is between approximately 10 inches and approximately 30 inches. In another embodiment, the diameter D is between approximately 15.5 inches and approximately 23 inches. In one embodiment, the diameter D is approximately 15.5 inches. In another embodiment, the diameter D is approximately 17 inches. In another embodiment, the diameter D is approximately 18.5 inches. In another embodiment, the diameter D is approximately 20 inches. In another embodiment, the diameter is approximately 21.5 inches. In another embodiment, the height is approximately 23 inches. In other embodiments, the diameter may be an outer diameter.

With further reference to FIG. 2, the sidewall 22 has a thickness T. In one embodiment, the thickness T is between approximately 3 ply and approximately 13 ply (where a ply is approximately 0.0125 inches). In another embodiment, the thickness T is between approximately 4 ply and approximately 12 ply. In another embodiment, the thickness T is between approximately 5 ply and approximately 11 ply.

With further reference to FIG. 2A, the sidewall 22' has a thickness T. In one embodiment, the thickness T is between approximately 3 ply and approximately 13 ply (where a ply is approximately 0.0125 inches). In another embodiment, the thickness T is between approximately 4 ply and approximately 12 ply. In another embodiment, the thickness T is between approximately 5 ply and approximately 11 ply.

In one embodiment, the drum 20 has a volume of between approximately 15 gallons and approximately 70 gallons. In another embodiment, the drum 20 has a volume of between approximately 50 gallons and approximately 65 gallons. In another embodiment, the drum has a volume of between approximately 55 gallons and approximately 60 gallons.

In one embodiment, the drum 20 may be filled with food product, liquids, parts, medicine, edible or non-edible solids or liquids, powder, dry granular material, or any other suitable material. In one embodiment, the drum 20 is configured to hold between approximately 100 pounds and approximately 1000 pounds of material.

In one embodiment, the drum 20 is configured to be engaged and moved by machinery (e.g., an overhead hoist, etc.) with a grip contacting an area approximately 4 inches wide on opposite sides of the drum 20, with the grips with approximately 4 inches wide contact with the drum 20 each disposed in the channel 60 (see, e.g., FIGS. 4 and 4A), and configured to exert an upward force on the flange 56. In one embodiment, when the drum 20 is filled with approximately 800 pounds of material, the chime 24 and the sidewall 22 are coupled by the adhesive 84 and the bottom closure 28 and the sidewall 22 are coupled by the adhesive 126 such that the drum 20 may be suspended by the approximately 4 inch wide grips disposed in the channel 60 for at least approximately 2 minutes without failure. In another embodiment, with the drum 20 filled with approximately 800 pounds of material, the chime 24 and the sidewall 22 are coupled by the adhesive 84 and the bottom closure 28 and the sidewall 22 are coupled by the adhesive 126 such that the drum 20 may be suspended by the approximately 4 inch wide grips disposed on opposite sides of the drum 20 in the channel 60 for at least approximately 5 minutes without failure of the drum 20. In another embodiment, with the drum 20 filled with approximately 800 pounds of material, the chime 24 and the sidewall 22 are coupled by the adhesive 84 and the bottom closure 28 and the sidewall 22 are coupled by the adhesive 126 such that the drum 20 may be suspended by the approximately 4 inch wide grips disposed on opposite sides of the drum 20 in the channel 60 for at least approximately 10 minutes without failure of the drum 20.

In one embodiment, the adhesive 84 is disposed in the channel 66 prior to the sidewall 22 being disposed in the channel 66. In another embodiment, the adhesive 84 is applied to the sidewall 22 prior to the sidewall 22 being located in the channel 66. In another embodiment, the adhesive 84 is applied into the channel 66 after the sidewall 22 has been located in the channel 66. In other embodiments, any combination of these methods of applying adhesive may be used.

In one embodiment, the adhesive 126 is disposed in the channel 108 of the bottom closure 28 prior to the sidewall 22 being disposed in the channel 108. In another embodiment, the adhesive 126 is applied to the sidewall 22 prior to the sidewall 22 prior to the sidewall 22 being disposed in the channel 108. In another embodiment, the adhesive 126 is applied into the channel 108 after the sidewall 22 has been located in the channel 108. In other embodiments, any combination of these methods of applying adhesive may be used.

In one embodiment, the sidewall 22 is formed from a suitable fibrous material. In one embodiment, the fibrous material is fiberboard. In other embodiments, the sidewall 22 may be formed from any other suitable material. In one embodiment, the sidewall 22 is formed by rolling paper layers around a forming tube with an adhesive between layers to bond the layers. In other embodiments, the sidewall 22 may be formed by any other suitable mechanism. In one embodiment, the sidewall 22 is lined with a liner. In one embodiment, the liner is formed from plastic. In one embodiment, the plastic is high density polyethylene (HDPE). In another embodiment, the plastic may be any suitable thermoplastic. In other embodiments, the liner may be formed of any other suitable material.

With reference to FIG. 3, in one embodiment, the discontinuous threading portions 48 are threaded portions that are open at one end and terminate in stops 51 at the other end. The discontinuous threading portions are separated by gaps 49 without threading. Similarly, with reference to FIG. 5, the discontinuous threading portions 100 are threaded portions separated by gaps 101 without threading. To engage the threading portions 48 and 100, the threading portions 100 are placed in the gaps 49 (which places the threading portions 48 in the gaps 101), and the top closure 26 is rotated about the longitudinal axis of the sidewall 22, causing the threading portions 100 to engage with the threading portions 48. As the top closure 26 is rotated, the threading portions 100 encounter the stops 51 and the top closure 26 is inhibited from being rotated further in the direction towards the stops 51.

In one embodiment, the discontinuous threading portions 48 and 100 are configured such that the top closure 26 may be rotated about the longitudinal axis of the sidewall 22 less than approximately 90 degrees to secure the top closure 26 to the chime 24 (e.g., until the threading portions 100 encounter the stops 51). In another embodiment, the discontinuous threading portions 48 and 100 are configured such that the top closure 26 may be rotated about the longitudinal axis of the sidewall 22 less than 30 degrees to secure the top closure 26 to the chime 24 (e.g., until the threading portions 100 encounter the stops 51). In another embodiment, the discontinuous threading portions 48 and 100 are configured such that the top closure 26 may be rotated about the longitudinal axis of the sidewall 22 approximately 15 degrees to secure the top closure 26 to the chime 24 (e.g., until the threading portions 100 encounter the stops 51).

Additionally, in one embodiment the chime 24 and the top closure 26 are formed by molding. In one embodiment, the discontinuous threading portions 48 and 100 are configured such that the chime 24 and the top closure 26 may be rotated relative to the molds less than 90 degrees to remove the chime 24 and the top closure 26 from the molds. In another embodiment, the discontinuous threading portions 48 and 100 are configured such that the chime 24 and the top closure 26 may be rotated relative to the molds less than 30 degrees to remove the chime 24 and the top closure 26 from the molds. In another embodiment, the discontinuous threading portions 48 and 100 are configured such that the chime 24 and the top closure 26 may be rotated relative to the molds approximately 15 degrees to remove the chime 24 and the top closure 26 from the molds.

In one embodiment, the adhesive 84 coupling the chime 24 to the sidewall 22 is a thermoplastic adhesive. In another embodiment, the adhesive 84 coupling the chime 24 to the sidewall 22 is a structural adhesive. In another embodiment, the adhesive 84 coupling the chime 24 to the sidewall 22 is an acrylic adhesive. In another embodiment, the adhesive 84 coupling the chime 24 to the sidewall 22 is a 2-part acrylic adhesive, such as, e.g., SCOTCH-WELD™ STRUCTURAL ADHESIVE DP 8005 (Translucent), produced by 3M Tapes & Adhesives Group and 3M Industrial Adhesives and Tapes Division. In other embodiments, any suitable type of adhesive may be used to couple the chime 24 to the sidewall 22.

In one embodiment, the adhesive 126 coupling the bottom closure 28 to the sidewall 22 is a thermoplastic adhesive. In another embodiment, the adhesive 126 coupling the bottom closure 28 to the sidewall 22 is a structural adhesive. In another embodiment, the adhesive 126 coupling the bottom closure 28 to the sidewall 22 is an acrylic adhesive. In another embodiment, the adhesive 126 coupling the bottom closure 28 to the sidewall 22 is a 2-part acrylic adhesive, such as, e.g., SCOTCH-WELD™ Structural Adhesive DP 8005 (Translucent), produced by 3M Tapes & Adhesives Group and 3M Industrial Adhesives and Tapes Division. In other embodiments, any suitable type of adhesive may be used to couple the bottom closure 28 to the sidewall 22.

In one embodiment, the adhesives 84 and 126 each chemically reacts with the base and the chime respectively prior to curing and when placed in contact with the base and the chime. In one embodiment, the adhesives 84 and 126 chemically bond with plastic such as, for example, high density polyethylene, prior to curing and when placed in contact with the high density polyethylene.

In one embodiment of a method of providing a container, adhesive coupling the chime and bottom closure to the sidewall is a two-part adhesive and the method of providing the container includes mixing the two parts to form the adhesive. In one embodiment, the two parts are a methacrylate and an amine. In one embodiment, the adhesive is approximately 10 parts methacrylate to approximately 1 part amine. In another embodiment, the adhesive is approximately 9.16 parts methacrylate to approximately 1 part amine. In other embodiments, other suitable combinations may be used.

In one embodiment, the adhesives 84 and 126 are adhesives configured to bond polyolefins and low surface energy materials, e.g., fibrous materials, fiberboard, etc. In one embodiment, the overlap shear strength of the adhesives 84 and 126 at 75° Fahrenheit is greater than approximately 1000 psi. In another embodiment, the overlap shear strength of the adhesives 84 and 126 at 75° Fahrenheit is greater than approximately 2000 psi. In another embodiment, the overlap shear strength of the adhesives 84 and 126 at 75° Fahrenheit is approximately 2400 psi.

In one embodiment, the adhesives 84 and 126 are configured to bond to, for example, polyolefins without surface preparation of the polyolefins.

In one embodiment, by coupling the chime 24 and the bottom closure 28 to the sidewall 22 with adhesive, the coupling may be accomplished cheaply, reliably, and accurately, without the use of additional parts (e.g., bolts, screws, pins, etc.), without the use of additional processes (e.g., crimping, sonic welding, twisting chime 24 and/or bottom closure 28 onto the sidewall 22 so that threading penetrates and/or deforms the surface of the sidewall, etc.), and without the use of additional features (e.g., threading, etc.).

In one embodiment, the chime 24 and/or the bottom closure 28 may be coupled to the sidewall 22 by moving the chime 24 and/or the bottom closure 28 in a direction along the longitudinal axis of the sidewall 22 toward the sidewall 22 and without rotating the chime 24 and/or bottom closure 28 about the longitudinal axis of the sidewall 22 more than approximately 25 degrees relative to the sidewall 22. In another embodiment, the chime 24 and/or the bottom closure 28 may be coupled to the sidewall 22 by moving the chime 24 and/or the bottom closure 28 toward the sidewall 22 in a direction along the longitudinal axis of the sidewall 22 and without rotating the chime 24 and/or bottom closure 28 about the longitudinal axis of the sidewall 22 more than approximately 15 degrees relative to the sidewall 22. In another embodiment, the chime 24 and/or the bottom closure 28 may be coupled to the sidewall 22 by moving the chime 24 and/or the bottom closure 28 toward the sidewall 22 in a direction along the longitudinal axis of the sidewall 22 and without rotating the chime 24 and/or bottom closure 28 about the longitudinal axis of the sidewall 22 more than approximately 5 degrees relative to the sidewall 22. In one embodiment, coupling the chime 24 and/or bottom closure 28 to the sidewall 22 by any of the methods described above may provide for accurate, easy, cheap, and reliable coupling of the chime 24 and/or bottom closure 28 to the sidewall 22. In another embodiment, coupling the chime 24 and/or the bottom closure 28 to the sidewall 22 by any of the methods described may provide for coupling of the chime 24 and/or bottom closure 28 to the sidewall 22 without the inner and/or outer surfaces of the sidewall 22 being penetrated and/or deformed.

In one embodiment, the sidewall 22 forms a right cylinder. In other embodiments, the sidewall 22 may form any other suitable shape. In other embodiments, the sidewall 22 may form a cylinder of varying diameter along its longitudinal axis.

In one embodiment, the chime 24 is formed of a plastic. In one embodiment, the plastic is high density polyethylene (HDPE). In another embodiment, the plastic is polypropylene. In other embodiments, the plastic may be any suitable polyolefin. In other embodiments, the plastic may be formed of any suitable synthetic resin. In other embodiments, the plastic may be any suitable type of thermosetting polymer or thermoplastic. In other embodiments, the chime 24 may be formed of any suitable type of material. In one embodiment, the chime 24 is formed by molding. In other embodiments, the chime 24 may be formed by any other suitable method.

In one embodiment, the bottom closure 28 is formed of a plastic. In one embodiment, the plastic is high density polyethylene (HDPE). In another embodiment, the plastic is polypropylene. In other embodiments, the plastic may be any suitable polyolefin. In other embodiments, the plastic may be formed of any suitable synthetic resin. In other embodiments, the plastic may be any suitable type of thermosetting polymer or thermoplastic. In other embodiments, the bottom closure 28 may be formed of any suitable type of material. In one embodiment, the bottom closure 28 is formed by molding. In other embodiments, the bottom closure 28 may be formed by any other suitable method.

In one embodiment, the top closure 26 is formed of a plastic. In one embodiment, the plastic is high density polyethylene (HDPE). In another embodiment, the plastic is polypropylene. In other embodiments, the plastic may be any suitable polyolefin. In other embodiments, the plastic may be formed of any suitable synthetic resin. In other embodiments, the plastic may be any suitable type of thermosetting polymer or thermoplastic. In other embodiments, the top closure 26 may be formed of any suitable type of material. In one embodiment, the top closure 26 is formed by molding. In other embodiments, the top closure 26 may be formed by any other suitable method.

In one embodiment, the apertures in the sidewall 22 may be formed in pairs that are located spaced apart around the circumference of the sidewall 22 and offset relative to one another in a direction parallel to the longitudinal axis of the sidewall 22. In another embodiment, the apertures in the sidewall 22 may be single apertures or sets of three apertures or any other suitable number of apertures located around the circumference of the sidewall 22 and offset relative to the other single apertures or sets of apertures in a direction parallel to the longitudinal axis of the sidewall 22. In another embodiment, the apertures in the sidewall 22 may be randomly distributed both radially around the circumference of the sidewall 22 and/or in a direction parallel with the longitudinal axis of the sidewall 22. In another embodiment, the apertures may be generally aligned with one another relative to the longitudinal axis of the sidewall 22.

In one embodiment, apertures in the sidewall 22 may be provided as perforations. In one embodiment, the perforations are generally square-shaped. In another embodiment, the perforations are round. In other embodiments, the perforations may be regular or irregular polygonal in shape. In other embodiments, the perforations may be of any other suitable shape. In another embodiment, the sidewall 22 may be formed with apertures. In another embodiment, the apertures may be provided after the forming of the sidewall 22 by perforating the sidewall 22 or by any other suitable method.

In another embodiment, the sidewall 22 is continuous and does not include apertures proximate the first end 30 and/or the second end 32 of the sidewall 22.

Some embodiments of chimes and bottom closures include two grooves defined in the surfaces of inner walls and outer walls proximate the channels. In other embodiments, any suitable number of grooves may be defined in the surfaces of the inner walls and outer walls proximate the channels.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention. While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

What is claimed is:

1. A shipping drum comprising:

a fibrous cylindrical sidewall extending along a longitudinal axis from a first end to a second end and having an inner surface and an outer surface;

a bottom closure formed from a first plastic material and including inner and outer walls proximate the radial periphery of the bottom closure, the inner and outer walls defining a channel configured to receive the second end of the sidewall therein; and an adhesive formed from a second material different from the first plastic material of the bottom closure, the adhesive bonded to the sidewall and to the inner and outer walls of the bottom closure such that the bottom closure closes the second end of the cylindrical sidewall;

wherein the bottom closure is coupled to the sidewall without the bottom closure penetrating or deforming the outer surface of the sidewall;

wherein the adhesive located in the channel of the bottom closure forms a chemical bond with the bottom closure and wherein the adhesive is in contact with the bottom closure.

2. The shipping drum of claim 1, further comprising a plastic chime including an inner wall and an outer wall defining a channel therebetween configured to receive the first end of the sidewall; and an adhesive in the channel between the inner wall and the outer wall of the chime coupling the sidewall to the inner and outer walls of the chime;

wherein the chime is coupled to the sidewall without the chime penetrating the inner or outer surface of the sidewall.

3. The shipping drum of claim 2, wherein the sidewall includes a plurality of apertures proximate the first end, a portion of the sidewall including the apertures being located in the channel of the chime; and wherein the sidewall includes a plurality of apertures defined in the sidewall proximate the second end.

4. The shipping drum of claim 3, wherein the adhesive located in the channel of the chime extends from the outer wall of the chime through at least one of the apertures proximate the first end of the sidewall to the inner wall of the chime.

5. The shipping drum of claim 2, wherein the adhesive located in the channel of the chime forms a chemical bond with the chime; and wherein the overlap shear strength of the bonded adhesive is at least 1000 psi.

6. The shipping drum of claim 5, wherein the overlap shear strength of the bonded adhesive is at least 2000 psi.

7. The shipping drum of claim 2, further comprising a top closure configured to be coupled to the chime to close the first end of the sidewall, the top closure including a plurality of discontinuous threading portions;

wherein the chime is an annular chime defining an open center; and wherein the chime includes a plurality of discontinuous threading portions configured to interact with the discontinuous threading portions of the top closure to couple the top closure to the chime.

8. The shipping drum of claim 7, wherein the chime includes between four and nine discontinuous threading portions spaced apart around the circumference of the chime.

9. The shipping drum of claim 1, configured to hold a volume of between of between approximately 55 gallons and approximately 60 gallons.

10. The shipping drum of claim 1, wherein the inner and outer walls of the bottom closure each include a surface proximate to the channel;

wherein the surface of the inner wall of the bottom closure proximate the channel includes a first groove;

wherein the surface of the outer wall of the bottom closure proximate the channel includes a second groove; and wherein the first groove and the second groove are offset relative to one another in the direction of the longitudinal axis of the sidewall.

11. The shipping drum of claim 2, wherein the inner and outer walls of the chime each include a surface proximate to the channel;

wherein the surface of the inner wall of the chime proximate the channel includes a first groove;

wherein the surface of the outer wall of the chime proximate the channel includes a second groove; and wherein the first groove and the second groove each extend at least partially around the circumference of the chime.

12. The shipping drum of claim 2, further comprising a top closure configured to be coupled to the chime to close the first end of the sidewall;

wherein the chime includes a radially outwardly projecting flange; and wherein the chime defines a channel below the radially outwardly projecting flange, the chime being configured to allow access to the channel to provide upwardly directed force on the flange with the top closure coupled to the chime.

13. The shipping drum of claim 1, wherein the bottom closure comprises a polyolefin; and wherein the adhesive is formed from a second material different from the polyolefin.

14. The shipping drum of claim 13, wherein the adhesive has two parts which are mixed to form the adhesive.

15. A drum comprising:

a fiberboard cylindrical sidewall surrounding a longitudinal axis and extending from a first end to a second end;

a plastic bottom closure including inner and outer walls defining a channel, the second end of the cylindrical sidewall located in the channel of the bottom closure;

a first adhesive located in the channel of the bottom closure, the first adhesive coupling the sidewall to the inner and outer walls of the bottom closure;

a plastic chime defining a central aperture and including inner and outer walls, a surface of the inner wall of the chime and a surface of the outer wall of the chime defining a channel therebetween, a first groove being defined in the surface of the inner wall of the chime, the first groove extending around at least a portion of the circumference of the inner wall of the chime, a second groove being defined in the surface of the outer wall of the chime, the second groove extending around at least a portion of the circumference of the outer wall of the chime, the portion of the outer wall of the chime in which the groove is defined having a thickness less than the thickness of the portion of the outer wall of the chime in which the groove is not defined, the first end of the cylindrical sidewall located in the channel of the chime; and a second adhesive located in the channel of the chime, the second adhesive coupling the sidewall to the inner and outer walls of the chime.

16. The drum of claim 15, wherein the inner and outer walls of the plastic bottom closure do not include threading.

17. The drum of claim 15, further comprising a top closure including a discontinuous threading portion;

wherein the chime includes a portion including a discontinuous threading portion to which the top closure is configured to be coupled; and wherein the discontinuous threading portion of the chime and the discontinuous threading portion of the top closure are configured to interact to couple the top closure to the chime without rotating the cover about the longitudinal axis of the sidewall more than 25 degrees.

18. The drum of claim 15, wherein a bottom portion of the first groove extends generally perpendicular to the longitudinal axis of the sidewall away from the sidewall.

19. A drum comprising:

a high density polyethylene bottom closure including inner and outer walls defining a channel, a fiber cylinder having a diameter in the range of 15 to 23 inches and extending between a first end which is between 30 and 44 inches from a second end of the cylinder, the first end located within the channel of the bottom closure; the high density polyethylene bottom closure and the fiber cylinder defining an interior of the drum;

a first portion of acrylic adhesive which chemically reacts with high density polyethylene bottom closure prior to curing and when placed in contact with high density polyethylene, the adhesive bonding the first end to the bottom closure within the channel of the bottom closure;

a high density polyethylene chime defining a central aperture and including inner and outer walls defining a channel therebetween, and discontinuous threads around the periphery of the chime;

a second portion of acrylic adhesive which chemically reacts with high density polyethylene prior to curing and when placed in contact with high density polyethylene, the adhesive bonding the second end to the chime within the channel of the chime; and approximately 800 pounds of content located in the interior of the drum, wherein the first portion of acrylic adhesive bonds the high density polyethylene bottom closure and the fiber cylinder such that the drum is configured to be filled with approximately 800 pounds of content and suspended support by upward force exerted on the chime for at least approximately 5 minutes without failure of the drum.

* * * * *